US006996944B2

(12) United States Patent
Shaw

(10) Patent No.: US 6,996,944 B2
(45) Date of Patent: Feb. 14, 2006

(54) FIRE BARRIERS FOR MULTI-DIMENSIONAL ARCHITECTURAL EXPANSION JOINTS

(76) Inventor: Alan Shaw, 5922 Collins Dr., Lockport, NY (US) 14094

( * ) Notice: Subject to any disclaimer, the term of this patent is extended or adjusted under 35 U.S.C. 154(b) by 0 days.

(21) Appl. No.: 10/894,112

(22) Filed: Jul. 19, 2004

(65) Prior Publication Data

US 2006/0010798 A1 Jan. 19, 2006

Related U.S. Application Data

(63) Continuation of application No. 10/854,392, filed on May 26, 2004, now abandoned.

(51) Int. Cl.
*E04B 1/62* (2006.01)

(52) U.S. Cl. ..... 52/232; 52/1; 52/396.01

(58) Field of Classification Search ..... 52/273, 52/1, 396.01, 232

See application file for complete search history.

(56) References Cited

U.S. PATENT DOCUMENTS

| | | | | |
|---|---|---|---|---|
| 3,521,546 | A * | 7/1970 | Day | 454/313 |
| 3,602,427 | A * | 8/1971 | Joesting | 236/82 |
| 4,502,842 | A * | 3/1985 | Currier et al. | 417/8 |
| 5,377,458 | A * | 1/1995 | Dempster | 52/1 |
| 5,502,937 | A * | 4/1996 | Wilson | 52/273 |
| 5,505,091 | A * | 4/1996 | Ali | 73/714 |
| 5,540,555 | A * | 7/1996 | Corso et al. | 417/44.2 |
| 5,645,866 | A * | 7/1997 | Eckardt et al. | 425/130 |
| 5,956,903 | A * | 9/1999 | Parker | 52/1 |
| 5,974,750 | A | 11/1999 | Landin et al. | |
| 6,128,874 | A | 10/2000 | Olson et al. | |
| 6,131,352 | A | 10/2000 | Barnes et al. | |
| 6,192,641 | B1 | 2/2001 | Andraso et al. | |
| 6,711,470 | B1 * | 3/2004 | Hartenstein et al. | 700/276 |
| 6,726,111 | B1 * | 4/2004 | Weimer et al. | 236/51 |
| 6,848,623 | B1 * | 2/2005 | Weimer et al. | 236/11 |

OTHER PUBLICATIONS

Thermal Structures, Incorporated Tire Barrier Systems, www.fs5800.com (Attached).

* cited by examiner

*Primary Examiner*—Basil Katcheves
(74) *Attorney, Agent, or Firm*—Patricia M. Costanzo

(57) ABSTRACT

Multi-dimensional, multi-layered, fire barriers for use in multi-dimensional architectural expansion joints may comprise a plurality of fire resistant material layers and the method for making such barriers is taught. The layers comprising the fire barriers may be connected together by stitching with high temperature thread, by stapling, by pins and bolts, by adhesive, or by any other bonding method. The fire barriers may be designed, for example, for use in a corner junction expansion joint, in a "T"-shaped expansion joint, or in a 4-way expansion joint, for example. A fire barrier may comprise: at least one protective and mechanically supporting layer; at least one insulating layer, and at least one layer of intumescent material, wherein the insulating layer is disposed between the mechanical support layer and the intumescent layer. The fire barriers may be provided completely ready to install or ready to assemble, as desired.

9 Claims, 27 Drawing Sheets

Fire barrier ready for installation into a horizontal "T" shape expansion joint.

Part 1 UNFOLDED

Part 1 FOLDED

Fire barrier ready for installation
into a horizontal "T" shape expansion joint.

Verical/horizontal 90 Degree Fire Barrier Template

Vertical/horizontal 90 Degree Fire Barrier with intumescent material layer (20) positioned on top of insulation blanket layer (40) which in turn is positioned on top of a layer of protective cloth (30).

Vertical/horizontal 90 degree fire barrier ready to install

Example of the fire barrier shaped and sized for installation in a vertical/horizontal 90 degree joint showing seaming by nuts and bolts.

45 Degree Fire Barrier

Plan view of 45 degree Fire Barrier ready for installation

Perspective view of 45 degree Fire Barrier ready for installation

Template for horizontal "T" joint with vertical 90 degree joint.

Template for two underlay parts to be positioned under and around the horizontal "T" arms.

Looking down leg of "T" view of fire barrier for horizontal "T" joint with vertical 90 degree joint.

Looking down arm of "T" of fire barrier for horizontal "T" joint with vertical 90 degree joint.

Form required for the seaming of a fire barrier to fit a 90 degree expansion joint.

Another view of the form required for the seaming of a fire barrier to fit a 90 degree expansion joint.

FIRE BARRIERS FOR MULTI-DIMENSIONAL ARCHITECTURAL EXPANSION JOINTS

CROSS-REFERENCE TO RELATED APPLICATIONS

This Continuation Application claims the benefit of United States Non-Provisional application Ser. No. 10/854,392 filed May 26, 2004 ABN.

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISK APPENDIX

Not Applicable

BACKGROUND OF THE INVENTION

The present invention relates generally to fire barriers and more particularly to fire barriers that can accommodate multi-dimensional joints.

The background information discussed below is presented to better illustrate the novelty and usefulness of the present invention. This background information is not admitted prior art. The particular versions of the invention as described below are provided, in part, as illustrative and exemplary. Thus, the described versions should not be taken as limiting. Additionally, the invention is not limited to the examples provided.

Customarily, buildings were built with static joints. Modern building codes, however, require that building design and construction now take into account factors that can, over time, change the physical dimensions of a structure. These factors include extreme or repetitive changes in temperature, the force of wind impinging on the building, forces due to seismic events, settling of the subsoil, remodeling of the building, or excavation on or near the site, among other factors. To accommodate the stress on the building caused by these factors without compromising the integrity of the building, architects and builders may design the structure in sub-units where the sub-units are meant to remain some small distances away from each other and meet at what is referred to as "expansion joints".

Expansion joints allow differential building movement to take place without risking damage to the whole structure. These joints represent gaps in the structure which can widen or narrow due to differential movement of adjacent structural units and/or can reduce the stress caused by shear motion of adjacent structural units. Dynamic moveable joints are often referred to in the trade as "construction joints," "soft joints," "dynamic voids", "seismic joints," and "expansion joints." Expansion joints or voids often occur where two wall sections, a wall and a floor, or a wall and ceiling meet, for example.

While the presence of these joints improves the integrity of the structure as a whole, they present a major risk to the structure in the event of a fire. The gaps at the joints provide easy pathways for flame, heat, and smoke to spread rapidly throughout the structure by utilizing what is known as the "chimney effect," that is the updraft created by heated air rising up through the structural gaps. Building codes for commercial structures generally require fire barriers capable of preventing flame and smoke from passing through building joints into adjoining areas. Various fire barrier means are available and include fire retardant and/or intumescent putties, caulks, wraps, and mats.

The fire barrier products mentioned above, although suitable for static joints, are generally not suitable for acting as fire barriers for dynamic joints. To reduce the risk created by the chimney effect due to dynamic joints, a number of attempts have been made to block the joints with fire resistant materials. A fire barrier for a dynamic joint generally needs to be capable of accommodating the complex differential movement of the building structural units and to retain its resiliency over an extended period of time under dynamic conditions. Further, during a fire event, the joint is likely to be subject to even greater movement, thereby making it essential that the fire barrier retains its integrity to prevent the migration of heat, flame, and smoke.

Commonly available are fire resistant materials, such as fire brick, which typically may be either rigid and/or brittle, or fire barrier blankets that are constructed of refractory fibers that are flexible but can be easily damaged.

Rigid and brittle materials have been adapted to sealing building joints while maintaining flexibility. This is accomplished by first creating hollowed out regions within the structural units that meet at a joint that is to be sealed with a fire resistant barrier. The fire resistant barrier, which consists of a thin layer of material of appropriate high-temperature properties, is then inserted into both hollowed gaps at the ends of the adjacent structural units. Thus, the widening or narrowing or shear motion of the adjacent plates is accommodated by the fire resistant barrier moving in a sliding fashion within the adjacent structural units. As long as the lateral dimensions of the barrier exceed the widest distance between the adjacent structural units during differential movement, the integrity of the barrier should remain. Similarly, when the structural units move together, the barrier should remain undamaged providing that the lateral dimension of the barrier is less than the distance between the bottoms of the hollowed out regions of the structural units. The major drawback of this approach is that the fire resistant material must be thin enough to fit within the hollowed out areas of the adjacent structural units. However, fabricating the hollowed out areas further complicates the construction of the building and increases the cost of the construction. Moreover, correct installation of such a barrier in a pre-existing building is difficult and expensive.

On the other hand, fire resistant materials can be fabricated into thin, flexible fibers which can be incorporated into flexible, fire resistant structures resembling a blanket. The advantages of such a material are that the fabrication is not very expensive, the draping of the blanket across a joint is readily accomplished and any differential movement of the adjacent structural units can be accommodated by incorporating an appropriate amount of slack in the blanket during installation. The blanket, however, is mechanically weak and can be easily damaged by tearing or ripping either accidentally or intentionally during or after installation thus largely compromising the integrity of the fire resistant barrier. A number of attempts have been made to protect the blanket from such mechanical damage. These have generally relied on the fabrication of a composite blanket which incorporates the fire resistant material between layers of a stronger, protective material such as metal foils or metal screens. The fire resistant layer can freely move with respect to these protective layers or they may be attached together via threads or similar attaching means.

Given the wide variety of movements that may occur between structural elements in a building, particularly one situated in a seismically active region, there still remains the possibility of gaps appearing in the fire barrier. To reseal these gaps in the event of a fire, intumescent materials are frequently added to the barrier. These are materials that expand when rapidly heated and at the same time have fire resistant properties. Thus, these provide a second method of sealing the structural gap in a building.

Attempts have been made to provide for sealing the dynamic joints that occur between structural units in a building. All of these solutions only provide for a fire barrier that is designed to obstruct air flow through a gap that occurs only between two building structures, such as the gap that occurs at the join of two walls. Many expansion joints, however, occur at the juncture of more than two building structures, such as where four walls meet to create a cross-wise gap, or where two exterior walls and an interior wall meet creating a "T"-shaped gap. Presently, there is no system which is capable of sealing a gap between more than two structural units in a building. None of the previously described fire barrier assemblies is capable of bridging the kind of multi-dimensional gap that occurs at the convergence of a plurality of structural units.

Thus, it is clear that what is sorely lacking in the art is a fire barrier that can accommodate that important safety need. It would be a significant improvement in the art to provide a fire barrier that is designed to provide a multi-pathway air flow obstacle. Ideally, the novel multi-dimensional fire barrier would ideally be constructed as a one piece, ready to install, unit to better ensures the integrity of the barrier when stressed and to allow for quicker and easier installation than would a multi-piece multi-dimensional fire barrier.

Accordingly, the invention described herein addresses this heretofore unmet need.

SUMMARY

The present invention satisfies the pressing need for means to prevent the rapid spread of flames, heat, and smoke throughout a structure caused by the "chimney effect," that is, the updraft created by multi-dimensional structural gaps.

The unique fire barrier structures as described herein offer fire barriers sized and designed to fit into multi-dimensional expansion joints occurring at the junction of more than two structures. The barriers made be provide ready to assemble or ready to install. One preferred version of the invention comprises a barrier made using a three layer construction that includes a layer of protective cloth, an insulating material layer (insulation blanket), and an intumescent material layer. The three layers are affixed together to form a fundamental layer using high-temperature resistant means. This barrier is not, however, the typical strip-type barrier that consists of one or more fire resistant layers simply superimposed one over the other.

The fire barrier of the present invention is unique in several ways. One point of novelty is the variety of three-dimensional configurations that can be accomplished using the fundamental layer regardless of the number or kinds of layers used to construct the fundamental layer. For example, in one aspect, the fundamental layer of the barrier is shaped into a unitary multi-dimensional barrier that is to be inserted directly into a corner expansion joint. Another aspect is a multi-dimensional barrier that fits into a "T" shaped space created by the convergence of three building structures, such as three walls, for example. In yet another aspect, a unitary multi-dimensional fire barrier is functionally designed to be fitted into the cross-wise or 4-way shaped expansion joints that are created by the confluence of four building structures, such as when four walls meet, for example. An additional aspect is a multi-dimensional fire barrier that fits into a vertical/horizontal 90 degree expansion joint. Another alternative is a multi-dimensional fire barrier that is operative for use in an expansion joint comprising a 45 degree angle. Yet another alternative multi-dimensional fire barrier is designed for use in a T-shaped joint having an additional joint that comes in at a right angle to the T-shaped expansion joint.

Yet another unique feature of the present invention is that regardless of the type of multi-dimensional expansion joint system that the fire barrier is intended to fit, all of the barriers are designed to have movement and expansion capabilities. Additionally, each of the materials used in the construction of the fire barriers meet Underwriters Laboratory, Inc. required specifications for materials used in a joint system.

Thus, the invention as described make available the above described advantages by providing for multi-dimensional fire barriers for use in multi-dimensional architectural expansion joints, wherein the fire barriers may comprise a plurality of fire resistant material layers. The fire resistant material layers may be connected together by stitching, stapling, using pins and bolts, using adhesive, or by any other bonding or connection method.

The multi-dimensional fire barriers, as taught may be operatively manufacture for use in a corner junction expansion joint, a "T"-shaped expansion joint, or in a 4-way expansion joint, a vertical/horizontal 90 degree expansion joint, an expansion joint comprising a 45 degree angle, and a T-shaped joint having an additional joint that comes in at a right angle to the T-shaped expansion joint, for example.

The multi-dimensional fire resistant barriers, according to the principles of the present invention may further comprise a plurality of fire resistant material layers including at least one mechanical support layer, at least one insulating layer, and at least one layer of intumescent material, wherein the insulating layer is disposed between the mechanical support layer and the one intumescent layer; and where the layers are bonded together substantially continuously along their to provide for multi-dimensional fire barriers operatively adapted for fitting into multi-dimensional architectural expansion joints.

The mechanical support and protective layer may be made from continuous filament amorphous silica yarns, polymeric material, fiber reinforced polymeric material, metallized fiber reinforced polymeric material, metallized, fiberglass cloth material, or inorganic fiber cloth material. The inorganic fibers may be selected from glass or ceramic fibers.

The insulating layer may be made from refractory ceramic fiber that may consist of alumina-silica, polycrystalline mullite, or glass mat materials.

The intumescent layer of the multi-dimensional fire barriers, may be selected from the group consisting of unexpanded vermiculite, hydrobiotite, water-swelling tetrasilicic fluorine mica, expandable graphite, or mixtures thereof. The intumescent layer may comprise a blend of fibers, wherein said fibers are selected from the group consisting of refractory ceramic fibers, high-temperature resistant glass fibers, or unexpanded vermiculite.

The method for making the multi-dimensional fire barriers comprises the steps of:

a) providing for at least one mechanical support layer;
b) providing for at least one insulating layer, and
c) providing for at least one layer of intumescent material,
d) disposing the insulating layer between the mechanical support layer and the intumescent layer; and e) bonding the layers together substantially continuously along their lengths to provide for multi-dimensional fire barriers operatively adapted for fitting into multi-dimensional architectural expansion joints.

Still other benefits and advantages of this invention will become apparent to those skilled in the art upon reading and understanding the following detailed specification and related drawings.

BRIEF DESCRIPTION OF THE DRAWINGS

In order that these and other objects, features, and advantages of the present invention may be more fully comprehended, the invention will now be described, by way of example, with reference to the accompanying drawings, wherein like reference characters indicate like parts throughout the several figures, and in which.

DEFINITIONS

Figure 1:
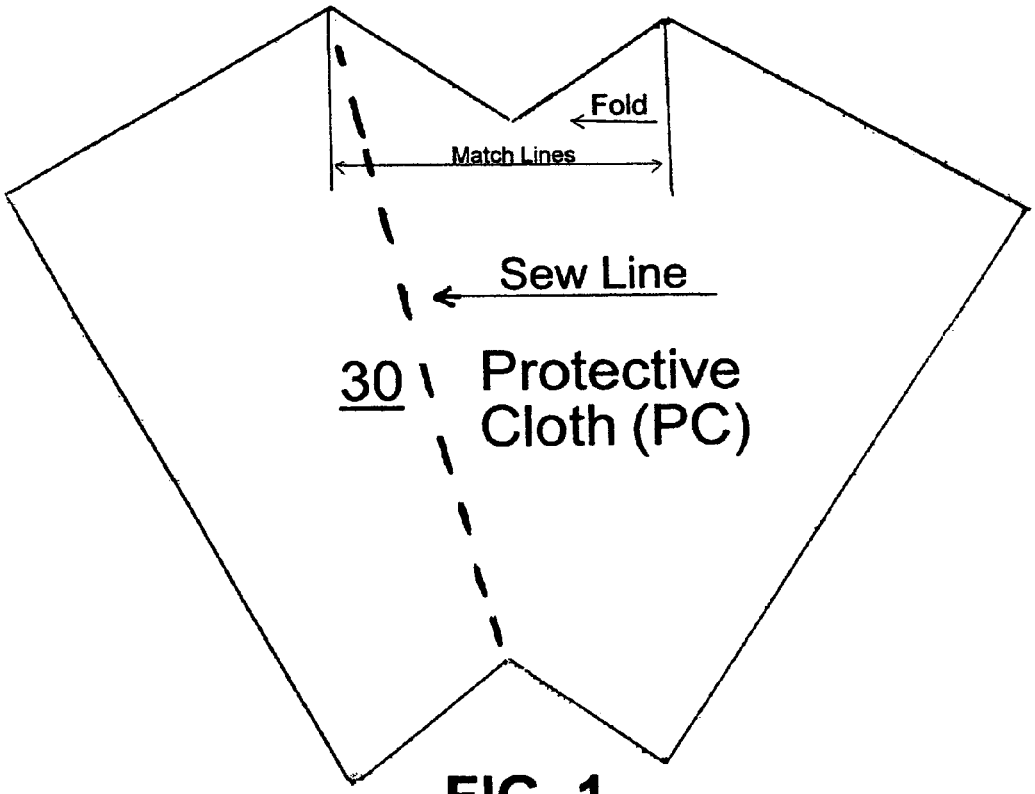
FIG. 1 is a plan view illustrating a template used in the cutting and sewing of protective cloth used in the construction of the multi-dimension fire barrier in accordance with the teachings of this invention so as to produce a cloth to accommodate an expansion joint that comprises a corner junction without having excess cloth bulk or causing tearing of the cloth.

"Intumescent" as used herein refers to those materials having properties that cause that material to expand when heated.

"Insulation blanket" as used herein refers to any number of insulator materials, including fiber blankets made from alumina, zirconia, and silica spun ceramic fibers, fiberglass, and the like.

"High-temperature thread" as used herein refers to any thread that is fire resistant or any thread that will not support combustion, such as a ceramic thread.

"Multi-dimensional architectural expansion joint" as used herein refers to any joint that is formed by the convergence of more than two structural units, such as the convergence of three wall units or two walls and a floor unit.

"Multi-dimensional fire resistant barrier" as used herein refers to any fire barrier that is functionally shaped to functionally fit into a multi-dimensional architectural expansion joint.

"Protective Cloth" as used herein refers to a flexible, strong, protective, fire-resistant material that is designed to mechanically support the insulation material and to protect the insulation material from mechanical damage, as the insulation is mechanically weak and can be easily damaged by tearing or ripping either accidentally or intentionally during or after installation thus largely compromising the integrity of the fire resistant barrier. The fire resistant layers, such as a layer of insulation material together with a layer of intumescent material, can freely move with respect to the one or more protective layers or they may be attached together via threads or other attaching means. Protective cloths may be manufactured from continuous filament amorphous silica yarns, polymeric material, fiber reinforced polymeric material, high-temperature resistant woven textiles, or a metalized, fiberglass cloth. Metalized cloth may include fibers of stainless steel, aluminum, or copper, for example. Protective materials may also include metal foils or metal screens.

"Seaming" as used herein refers to connecting one part to another part, for example where a cloth is folded and the two parts of the cloth that have been brought together by the folding are subsequently "seamed" together along a predetermined line. The seaming may utilize stitching, using an adhesive, stapling, pinning, or any other means that will connect the two parts to each other.

"Structural unit" as used herein refers to such constructs as a wall, floor, ceiling, or the like.

"Tri-dimensional" as used herein refers to either an expansion joint that has three member parts, such as a "T"-shaped expansion joint where the "T"-joint is made up of three co-joint-arms or to a fire barrier that is functionally shaped to accommodate a "T"-shaped joint.

"Tetra-dimensional" as used herein, refers to either an expansion joint that has four member parts, such as a cross-shaped expansion joint where the cross-joint is made up of four co-joint-arms or to a fire barrier that is functionally shaped to accommodate a cross-shaped joint.

A List of the Reference Numbers and Related Parts of the Invention

20 Intumescent strip material.
22 High-temperature thread.
30 Protective cloth.
40 Insulation blanket.
(S) Stitching
(PC) Protective cloth.

It should be understood that the drawings are not necessarily to scale. In certain instances, details which are not necessary for an understanding of the present invention or which render other details difficult to perceive may have been omitted. It should be understood, of course, that the invention is not limited to the particular versions illustrated herein, but encompasses many embodiments, such as those that are discussed throughout the specification. Expansion joint intersections occur in many configurations, as all of those configurations entail various combinations of vertical, horizontal, and corner joints, it will be appreciated that all of the configurations are embodied by this invention.

DETAILED DESCRIPTION

Referring now particularly to the drawings which show views of exemplary versions of some of the templates that are contemplated by this invention. The drawings also illustrate how the above mentioned disadvantages have been overcome. It should be noted that the disclosed invention is disposed to versions in various sizes, shapes, contents, and forms. Therefore, the versions described herein are provided with the understanding that the present disclosure is intended as illustrative and is not intended to limit the invention to the versions described herein.

Fire barriers are often, but not necessarily, constructed of three-layers; a thick insulation layer, an intumescent layer, and a protective cloth layer where the protective cloth is used to prevent the more susceptible insulation blanket from suffering physical damage, such as tearing. One preferred method of constructing the multi-dimensional fire barriers of this invention is to use the three-layer construction method, although it should be understood that many other methods and materials may also be used.

Figure 20:
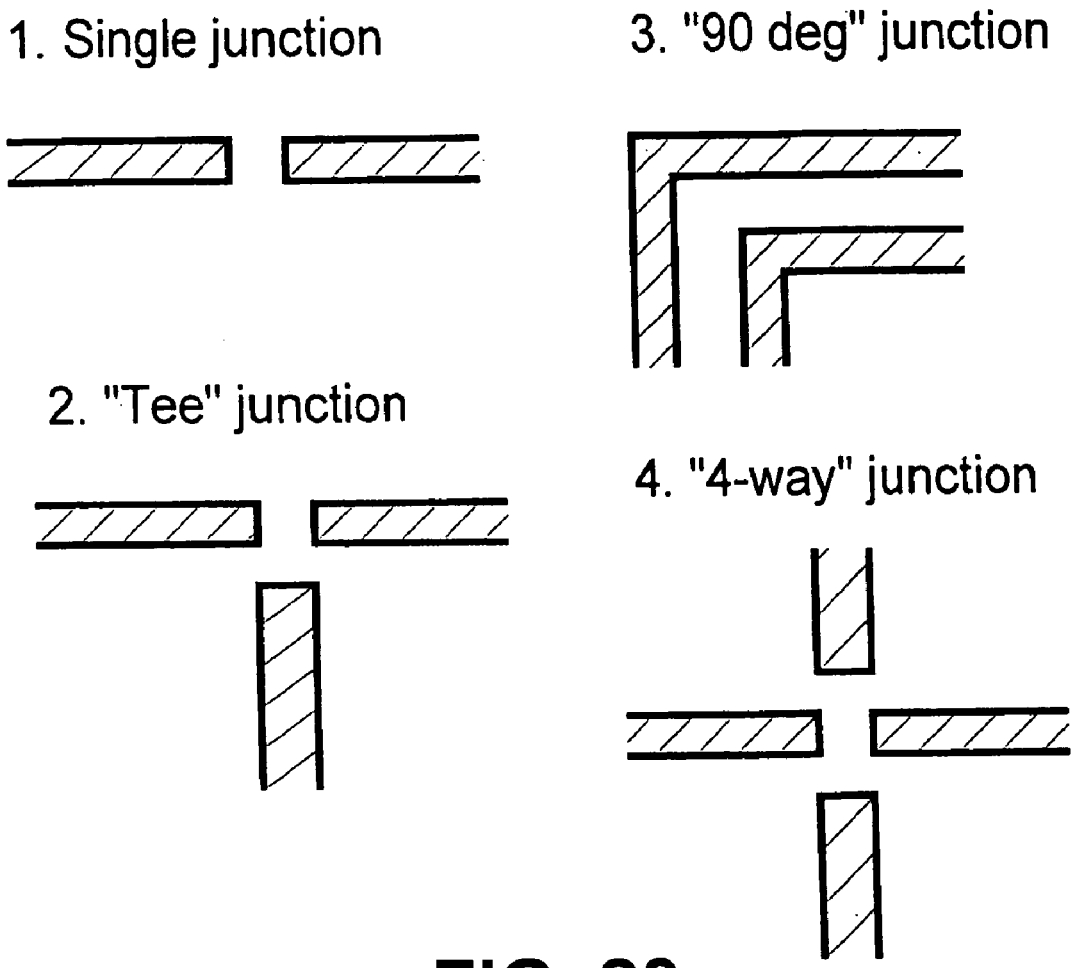
FIG. 20 is a plan view of four schematic multi-dimensional expansion joints.

Many variations of structural multi-dimensional expansion joints exist. FIG. 20 illustrates the basic one-dimensional, straight expansion joint and three multi-dimensional expansion joints. An example of one preferred version of the multi-dimensional fire barriers taught herein is an L-shaped fire barrier that fits into corner expansion joints. To construct the three-layered L-shaped fire barrier, protective cloth, which is one of the three-layers, is cut according to the template illustrated in FIG. 1 and then stitched along the "sew line." This assembly method produces a protective cloth jacket that fits neatly into a 90 degree junction expansion joint with tearing. Protective cloth, although strong and somewhat flexible, is often rigid enough to be prone to tearing when stressed by bending, such as by being forced to achieve a corner shape. Additionally, if the relatively thick protective cloth is folded to fit a corner without first shaping the cloth, as taught herein, an unacceptable bulky product will be produced. However, when the protective cloth is cut, folded, and seamed according to the pattern provided by the principles of this invention a custom-shaped multi-dimension L-shaped fire barrier without excess bulk is produced. Moreover, this unique method of shaping the protective cloth of the barrier eliminates the stresses on and potential for tearing of the protective cloth. The protective cloth may be seamed by stitching using a high-temperature thread, such as filamentous fused silica, for example. The L-shaped protective cloth cut, folded, and sewn according to this method is now ready to be used in the construction of a 90 degree expansion joint fire barrier unit. The protective cloth part, thus shaped, will be referred to as the first part of the L-shaped barrier.

Figure 2:
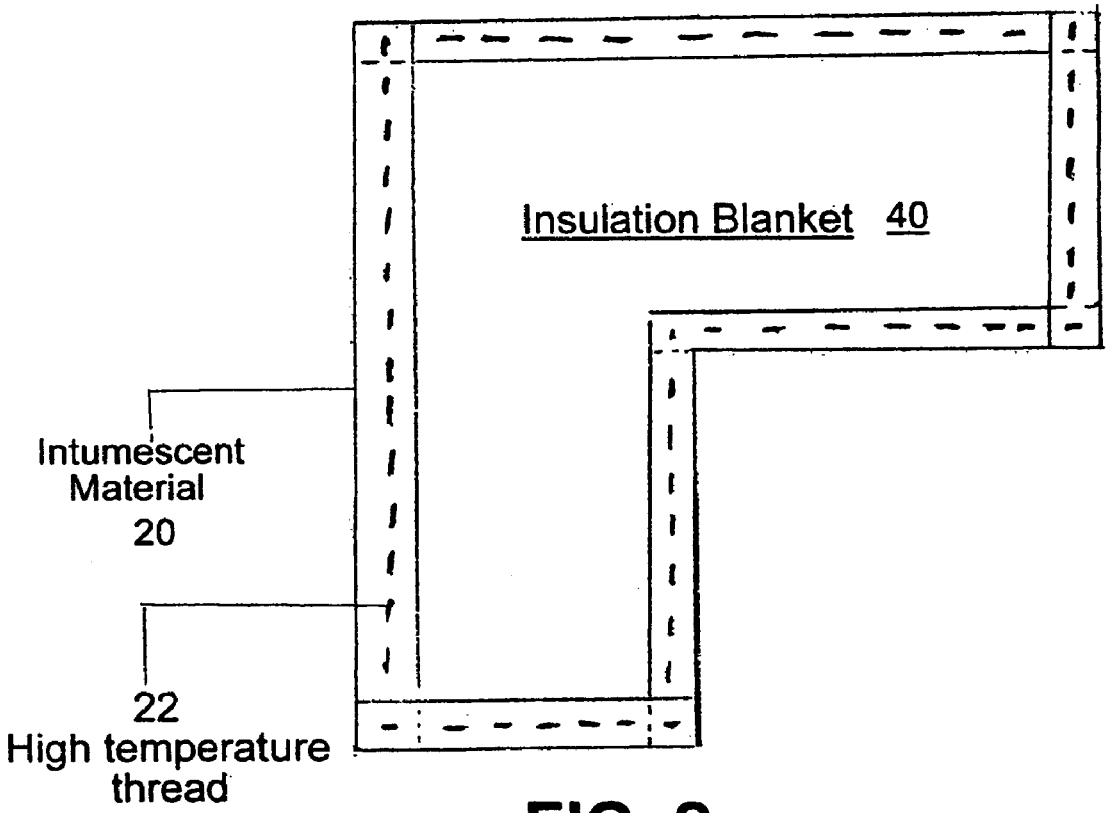
FIG. 2 is a plan view looking down on one part of a multi-dimension fire barrier that is to be fitted into protective cloth that has been folded and seamed for installation into a 90 degree expansion joint.

The second part of the L-shaped barrier as shown in FIG. 2, comprises the other two layers of the three-layer construction. In this example, a layer of intumescent material 20 strip-layers are positioned on insulation blanket layer 40, as shown. The two layers may be connected by stitching using high-temperature thread 22 at this point or they may be stitched together with the protective cloth after the following step.

Figure 3:
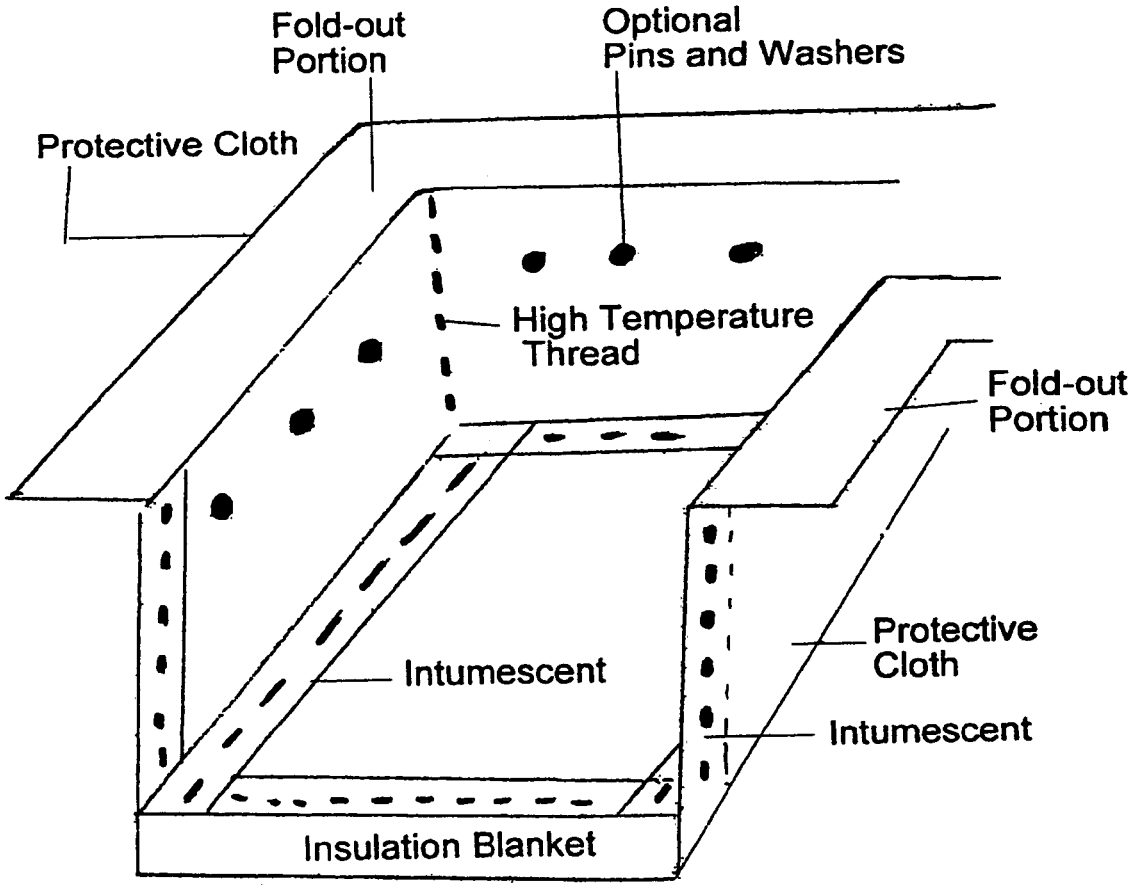
FIG. 3 is a perspective view looking down on and into a multi-dimension fire barrier ready for installation in a 90 degree expansion joint as shown in FIG. 2.

FIG. 3 is a perspective view looking down on and into a multi-dimension fire barrier preformed and ready to be installed in a 90 degree expansion joint. As can be seen, the insulation blanket and the intumescent strips, as shown in FIG. 2 have been placed into the L-shaped protective blanket. The three-layers are affixed together at this point by sewing or by any other desired fixation means, such as by stapling or by using pins and washers as illustrated in FIG. 3. As can be seen, the more easily damaged insulation blanket and the intumescent strips are supported and protected by the shaped layer of protective cloth. The intumescent material, which expands when a certain high-temperature is reached, is functionally positioned to provide the maximum amount of protection against the penetration of heat, flame, or smoke. The intumescent expansion prevents the passage of heat, flame, or smoke though openings that may have existed before being blocked by the swollen intumescent.

Figure 4:
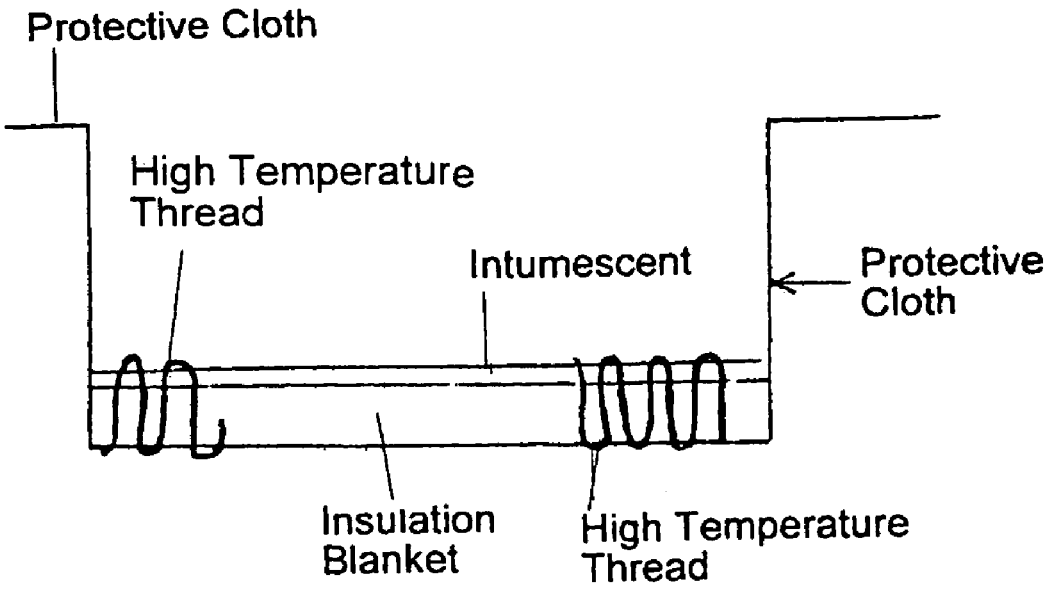
FIG. 4 is a cross-sectional view of a multi-dimension fire barrier installed in a 90 degree expansion joint as illustrated in FIG. 3 to show how stitching may be used to connect the layers.

As is shown in FIG. 4, the stitching that attaches the intumescent material to the blanket goes through the intumescent strips, the blanket, and the protective cloth, so that all three-layers are attached together to provide a unitary functional unit. Once the L-shaped fire barrier is situated in a 90 degree expansion joint it may be attached to the structural unit in a variety of ways, such as by riveting the fold-out portions of the protective blanket (as shown in FIG. 3) to the top of the structure.

Figure 5:
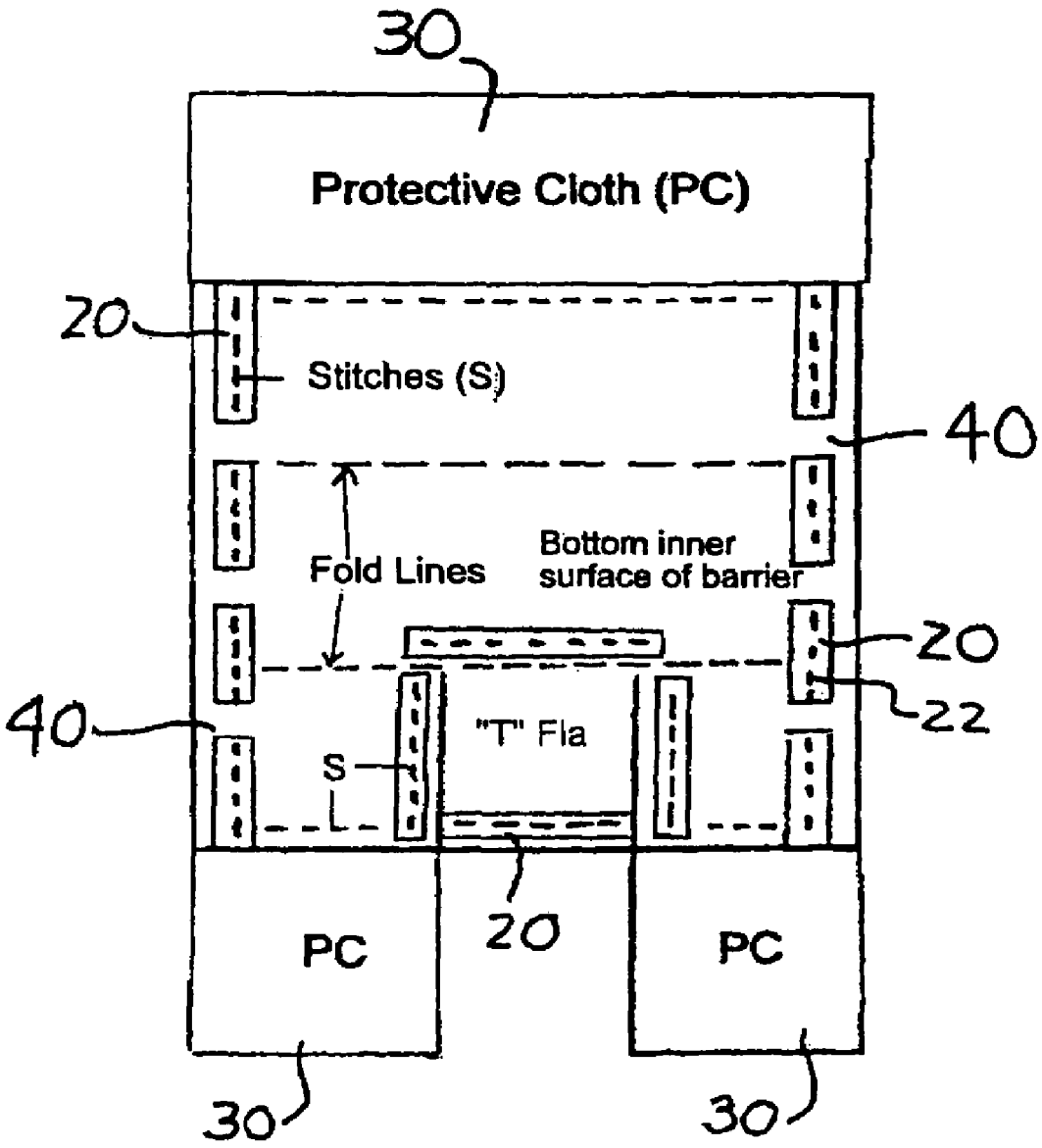
FIG. 5 is a plan view looking down onto unfolded Part 1 (i.e., the base-part) of a multi-dimension fire barrier to be installed in a "T" shaped expansion joint.
Figure 6:
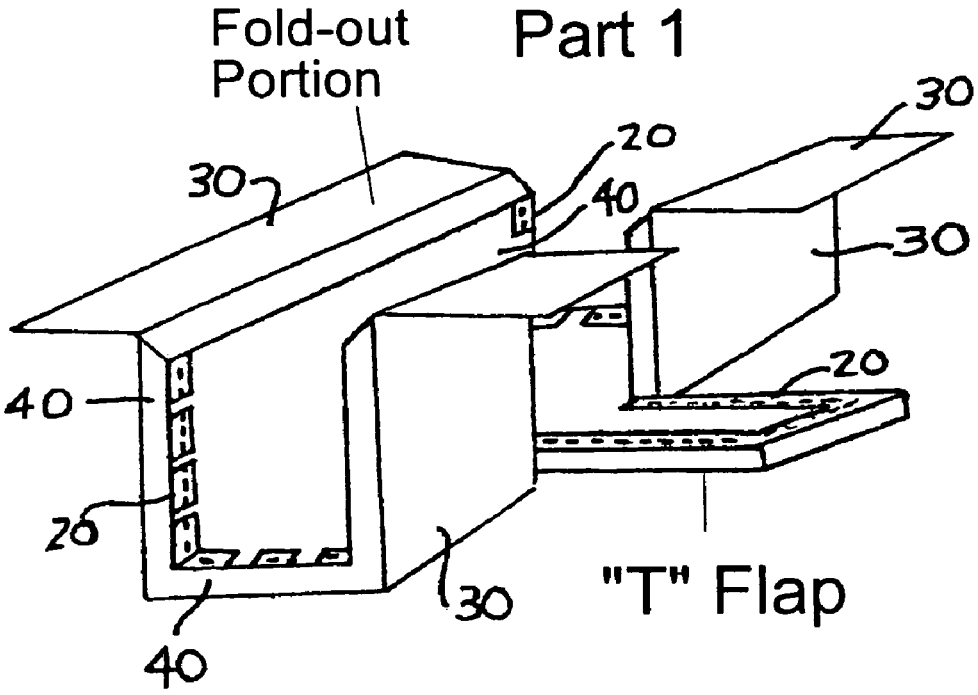
FIG. 6 is a perspective view of folded Part 1 as shown in FIG. 5.
Figure 7:
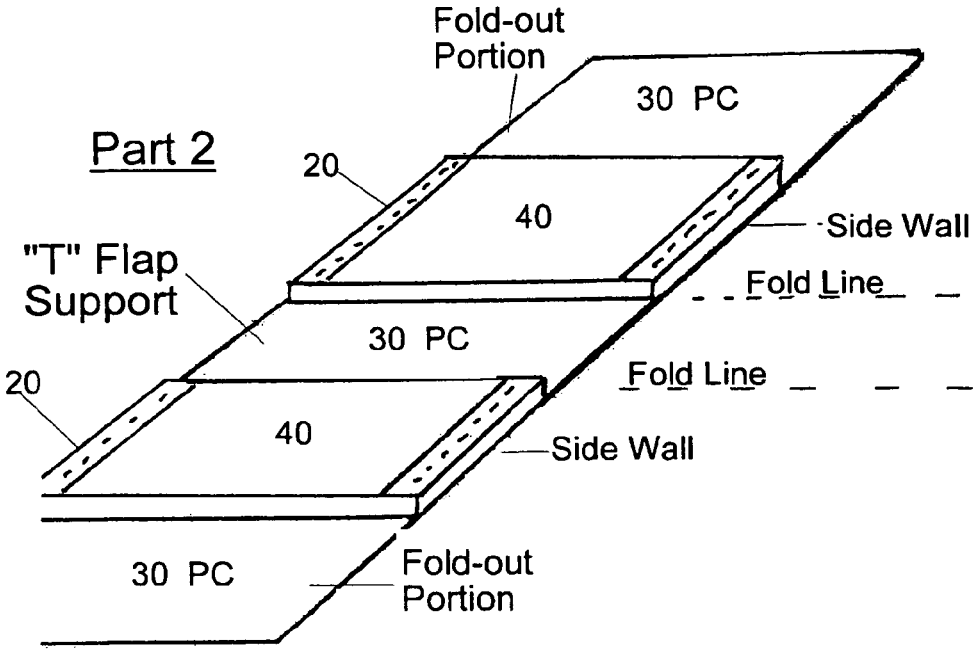
FIG. 7 is a perspective view of unfolded Part 2 of the multi-dimension fire barrier to be installed in a "T" shaped expansion joint.

Another expansion joint configuration that occurs frequently is the T-shaped expansion joint which occurs when three structures meet, such as the convergence of three walls. FIG. 5 shows the base part of a custom sized and styled T-shaped fire barrier. Also illustrated in FIG. 5 is the three-layer construction that was also used in the L-shaped fire barrier. It must again be pointed out, however, that other materials and other constructions may be used in the manufacture of a fire barrier. The novelty of this invention resides mainly in providing multi-dimensional fire barrier structures regardless of the materials used to make the structures, and in teaching the methods of making the custom-fit and custom-sized multi-dimensional fire barriers, where the fire barriers are produced as ready to install one-piece units, or if desired, may be provided unassembled to be assembled on-site. As shown in FIG. 5, strips of intumescent material 20 are functionally positioned on the surface of insulation blanket 40, which in turn is functionally positioned on protective cloth 30. Intumescent layer 20, insulation blanket 40, and protective cloth 30 are fixedly attached together to form an integral unit. In this example, the fixation is accomplished by stitching, as was shown in FIG. 4, using a high-temperature thread, although the fixation may be accomplished by any other fixation means, including staples and adhesive, for example. To prepare unfolded Part 1 (i.e., the base of the barrier), as illustrated in FIG. 5, for its union with Part 2 (i.e., the attachment part) as illustrated in FIG. 7, the top and bottom end of Part 1 (the base) are folded toward each other about the two fold lines shown in FIG. 5. Shown situated on each side of the "T" flap of the base, FIG. 5, are two extensions of insulator blanket 40. The inner edges of the two extensions of the insulator blanket, that is, the edges that border each side of the "T" flap, are constructed to be physically separate from the "T" flap (i.e., cut loose from the "T" flap) so that the "T" flap can be maintained in its folded out position while the two insulator blanket extensions along with the protective cloth extensions (denoted PC) are folded up, as is shown in FIG. 6.

FIG. 7 is a plan view looking down onto an unfolded second part (the attachment part) of a T-shaped multi-dimension fire barrier. To prepare Part 2 (the attachment part) for connection to Part 1 (the base section), the two side walls of Part 2 are folded up towards each other at the fold lines shown in the figure. Once this is accomplished, Part 2 is positioned so that the "T" flap support part of the base part is placed under the "T" flap of the attachment part. With Part 2 (the attachment part) so positioned, the folded-up side walls of Part 2 (the base part) provide side walls for the "T" flap extension of the T-shaped fire barrier. Finally, the fold-out portions are folded out to be used for attaching the fire barrier to the structure parts of the expansion joint.

Figure 7A:
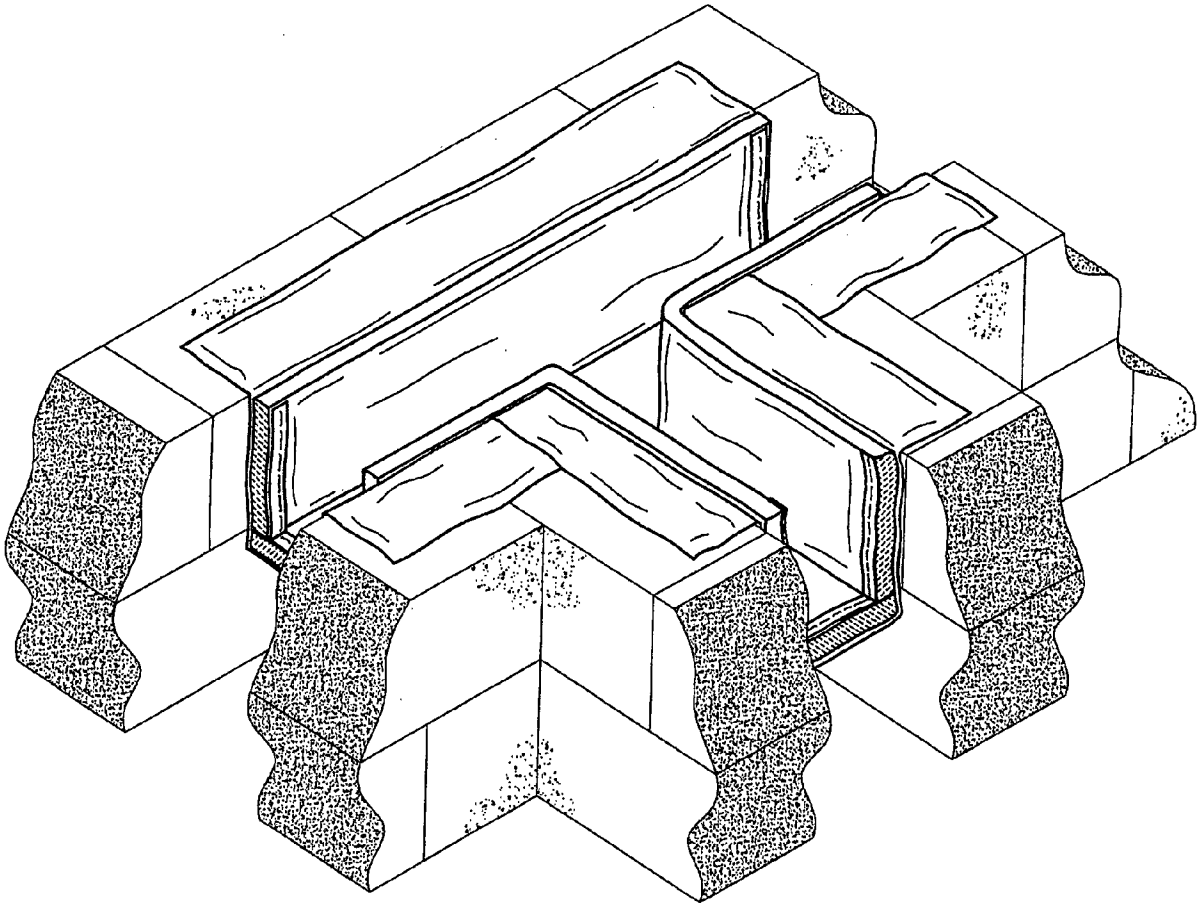
FIG. 7*a* is a perspective view of the "T" shaped expansion fire barrier ready for installation.

FIG. 7*a*, a perspective view of the "T" shaped expansion fire barrier ready for installation, illustrates the completely fabricated fire barrier with the addition of protective metal screening, which can be shipped directly to the construction site to be positioned in place. The barrier is permanently attached to the joint structure by any effective attachment means, such as by the use of rivets. The figure shows the use of clamps as the means to attach the barrier to the model expansion structure.

Another common multi-dimensional expansion joint configuration is that of the 4-way or cross-shaped joint. This joint occurs where four structures converge, such as the convergence of four walls, for example. How to make a fire barrier custom styled and sized for any 4-way junction is shown in FIGS. 8–10.

Figure 8:
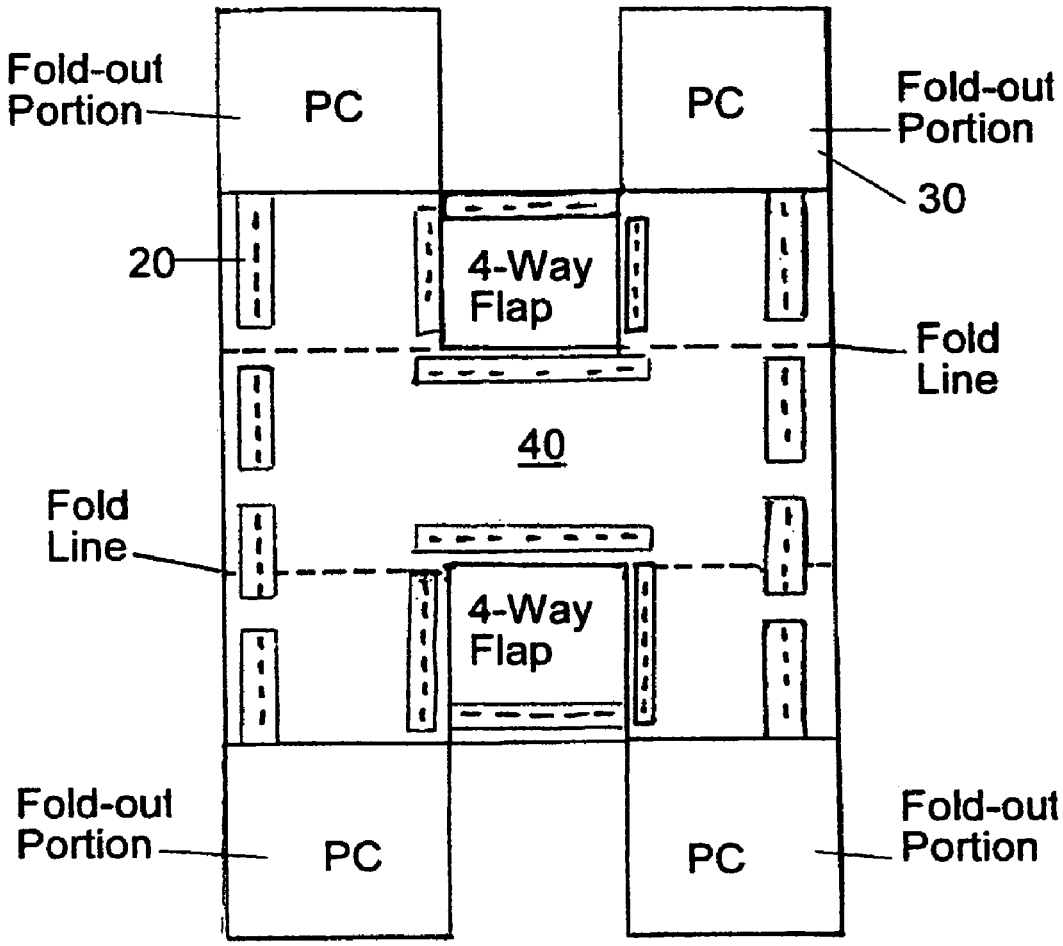
FIG. 8 is a plan view looking down onto the unfolded base-part of a multi-dimension fire barrier to be installed in a 4-way expansion joint.

FIG. 8 shows the base part of a 4-way fire barrier. As in the other examples, this example also employs three-layer construction, where the layers comprise an intumescent strip layer positioned on a layer of insulation material, which in turn is positioned on a layer of protective cloth. The three-layers are connected together by stitching (as shown in FIG. 4), where the stitching is accomplished using high-temperature thread. The design of the base part of the 4-way fire barrier uses the principals of the T-shaped fire barrier. In fact, the construct of the "T" flap end of the base part of the T-shaped fire barrier is simply followed on the two opposing ends of the base part of the 4-way fire barrier instead of on only one end of the base as is done in the T-shaped fire barrier.

Situated on each side of the two 4-way Flaps of the protective cloth base of the 4-way barrier are two extensions of insulator blanket 40. The inner edges of the two extensions of the insulator blanket, that is, the edges that border each side of the "T" flap, are constructed to be physically separate from the "T" flap, so that the "T" flap is kept open flat while the two insulator blanket extensions along with the protective cloth extensions (denoted PC) are folded up, as is shown in FIG. 9. The protective cloth extensions are subsequently folded out to be used for attaching the fire barrier to the structure parts of the expansion joint.

Figure 9:
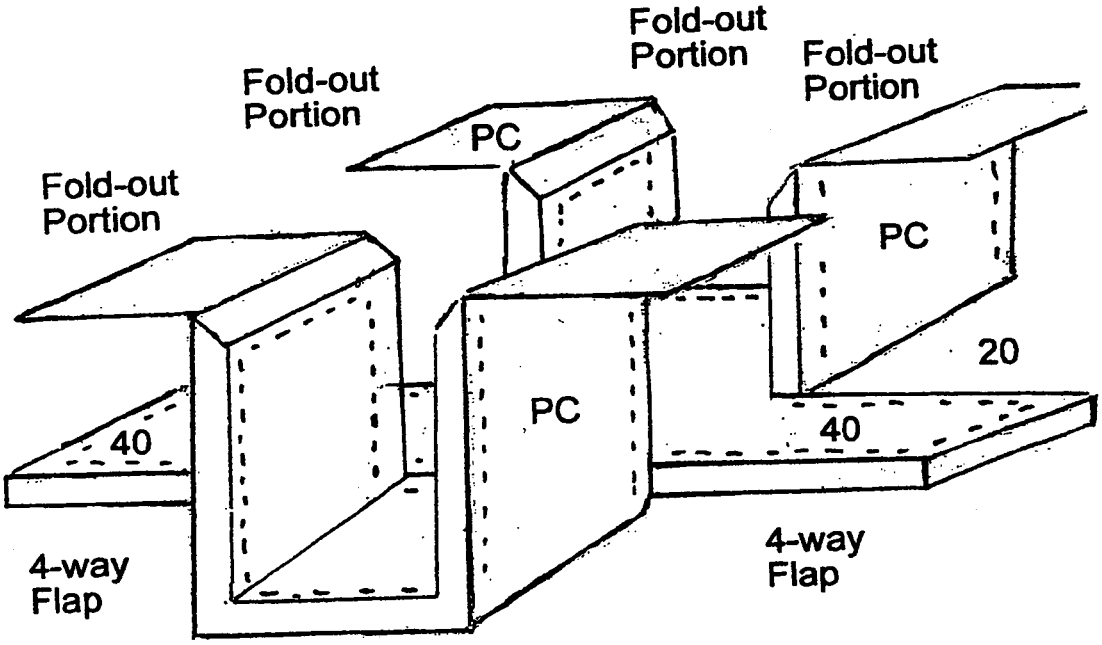
FIG. 9 is a perspective view of the folded base-part as shown in FIG. 8.
Figure 10:
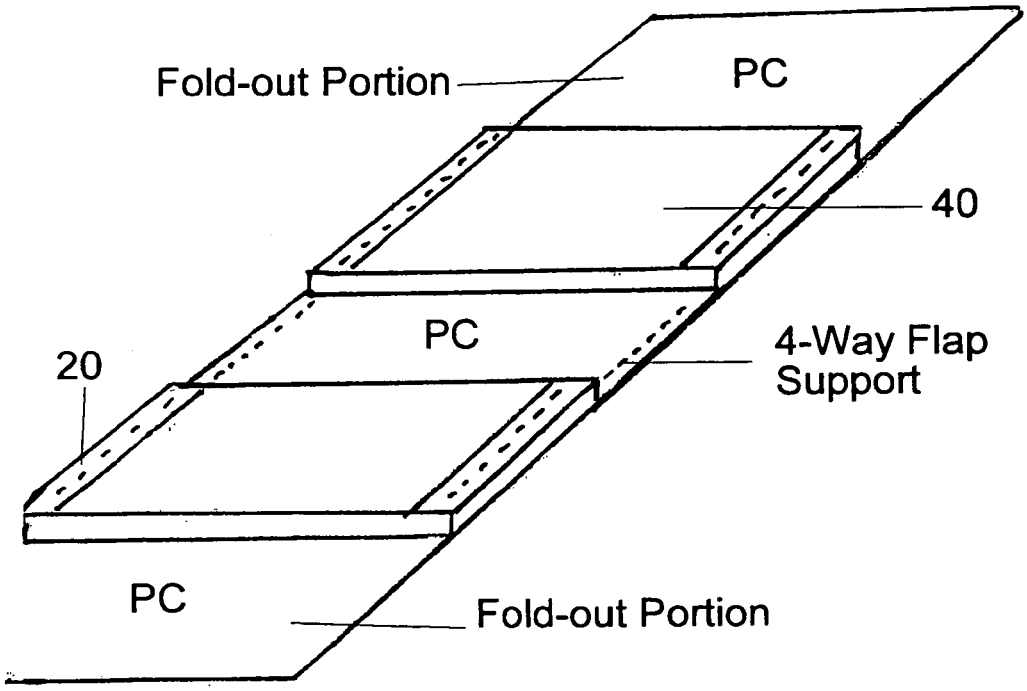
FIG. 10 is a plan view looking down onto an unfolded second part of a 4-way fire barrier.

Shown in FIG. 9 is the 4-way base folded up and out ready for the addition of the attachment parts. Note that in the case of the 4-way fire barrier there are two attachment parts. FIG. 10 illustrates one attachment part. Only one attachment part is shown in FIG. 10 as the two attachment parts required in the construction of a 4-way fire barrier are identical to each other and to the attachment part used in the T-shaped fire barrier. As in the T-shaped fire barrier, the "flap support" parts of the attachment parts (Part 2 in the T-shaped fire barrier) are each inserted beneath one of the two 4-way flaps. In this way, as in the previous example, insulator parts 20 then are in position to form the side barriers of the 4-way flap extensions. Once the two attachments are in position, as just described, the 4-way fire barrier is ready for installation in a 4-way extension joint.

Figure 11:
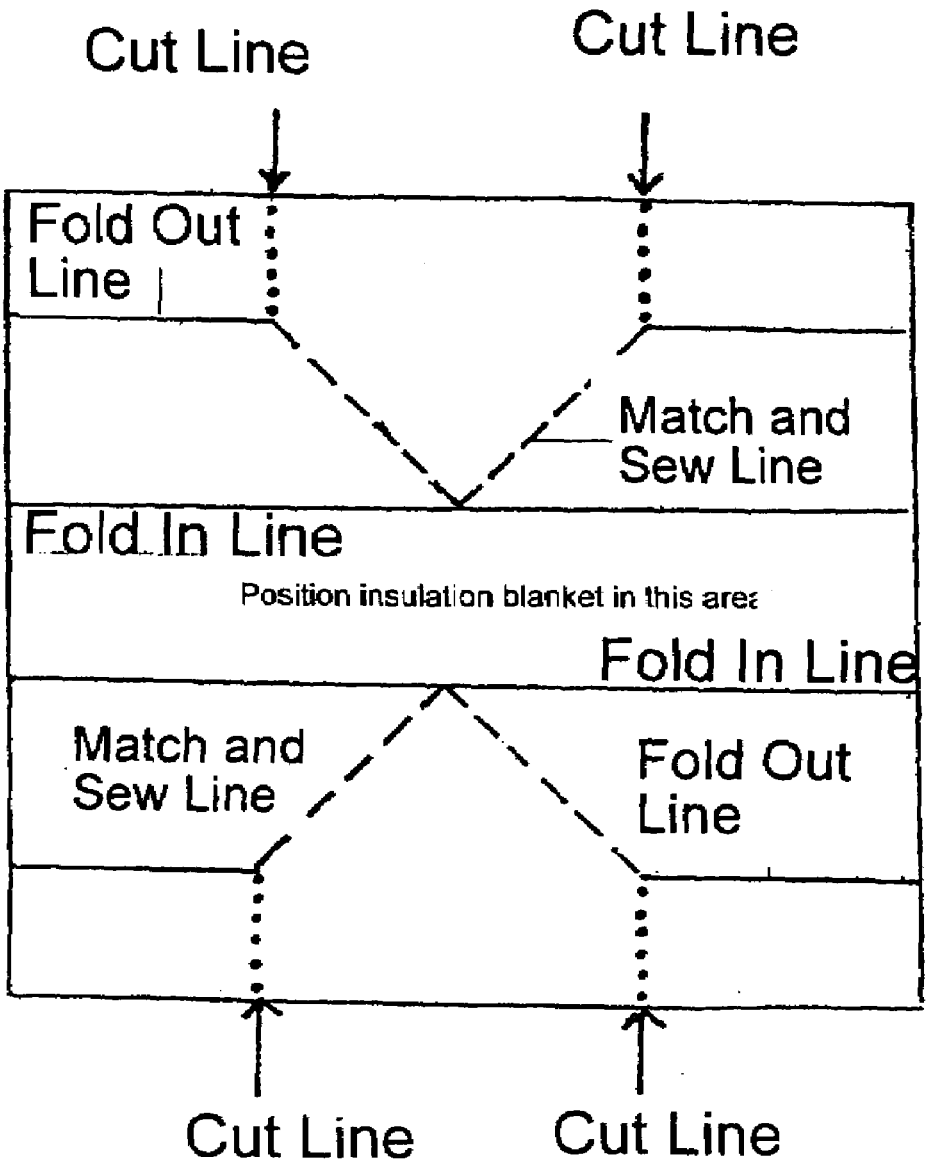
FIG. 11 is a plan view illustrating a template used in the cutting and sewing of the protective cloth used in the construction of a vertical/horizontal 90 degree fire barrier so as to produce a cloth to fit around an expansion joint that comprises a vertical/horizontal 90 junction without having excess cloth bulk or causing tearing of the cloth.

FIG. 11 shows a plan view of a template used to cut and sew protective cloth to construct a vertical/horizontal 90 degree fire barrier to fit a vertical/horizontal 90 degree junction expansion joint without having excess cloth bulk or causing tearing of the cloth. The template teaches four cut lines. Once these cuts are made in the protective cloth shaped according to the template, the cloth is folded about the four fold-out lines and two fold-in lines. The cloth is also to be folded about the two pair of angled pattern lines and then seamed, such as by being sewn together, for example, using the pattern lines as a stitching guide. The cutting, folding, and sewing of the protective cloth, as just described, results in the cloth assuming a chair-like shape, where the chair has arm-like and wing-like extensions. These extensions will be used to attach the finalized fire barrier to the structures. As in the previous examples, if stitching is the connection means used, high temperature thread is employed.

Figure 12:
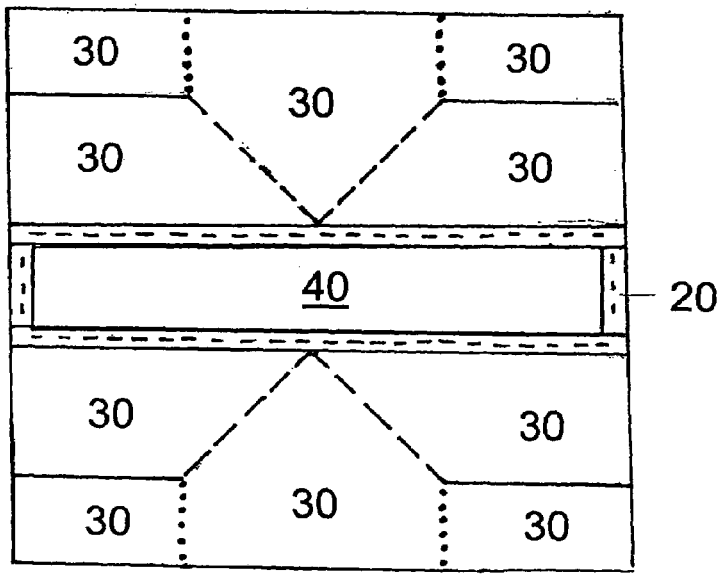
FIG. 12 is a plan view looking down onto a vertical/horizontal 90 degree fire barrier before it has been cut, folded, or stitched.

FIG. 12 is a plan view looking down onto a protective cloth patterned for cutting, folding, and seaming according to the vertical/horizontal 90 degree fire barrier template as illustrated in FIG. 11. In the designated (see FIG. 11) mid-area an insulation blanket has been positioned. Positioned on the edge surface area of the insulation blanket is a layer of intumescent stripping material. As in the previous examples, the three layers are connected together by stitching with high temperature thread.

Figure 13:
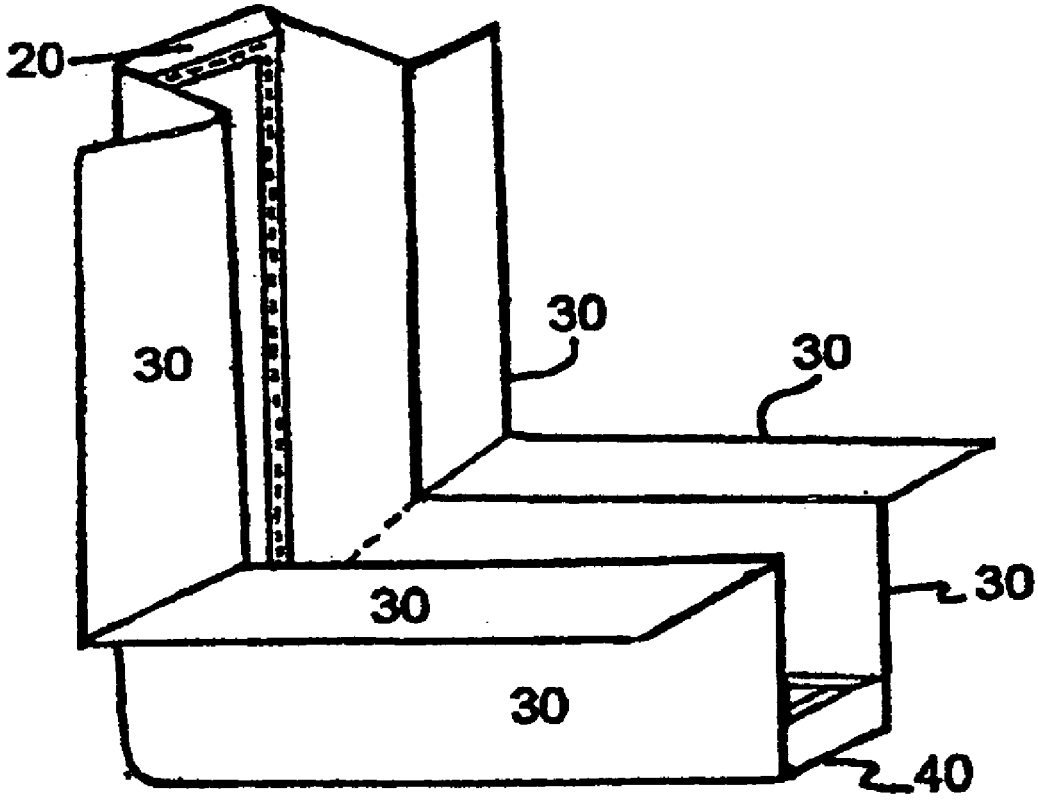
FIG. 13 is a perspective view of the vertical/horizontal 90 degree fire barrier, as shown in FIG. 12, prepared for installation.
Figure 13A:
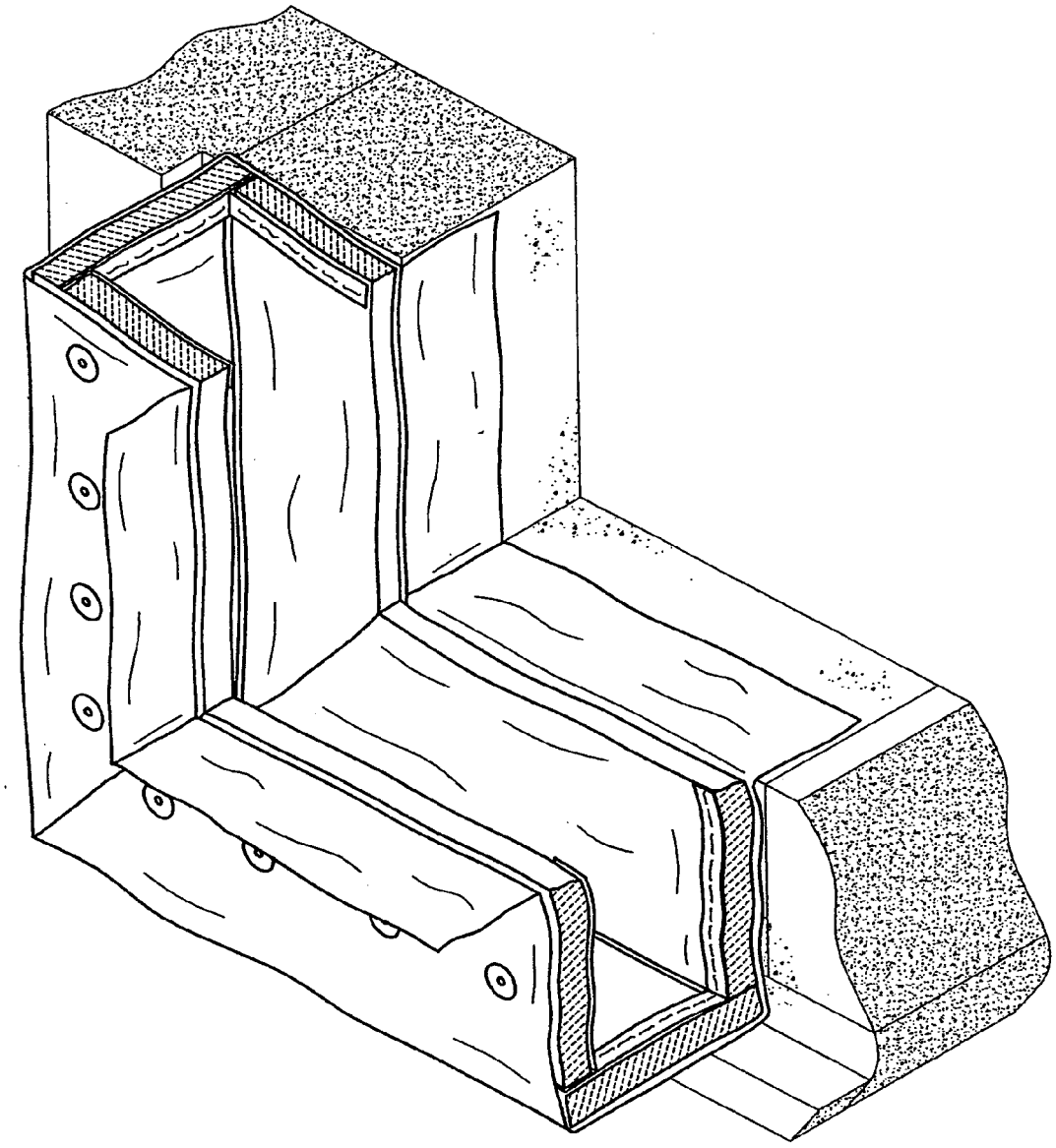
FIG. 13*a* is a perspective view of the vertical/horizontal 90 degree fire barrier, as shown in FIG. 12, seamed by the use of pins and bolts.

FIG. 13, a perspective view, shows the cut, folded, and sewn vertical/horizontal 90 degree fire barrier ready for installation in a vertical/horizontal 90 degree expansion joint. FIG. 13*a* shows the barrier seamed by the use of pins and bolts "installed" in a model vertical/horizontal 90 degree expansion joint. In this figure, the barrier is attached to the model expansion by clamps. In will be appreciated, that in an actual structure the barrier is permanently installed using any functional attachment means, such as rivets.

Figure 14:
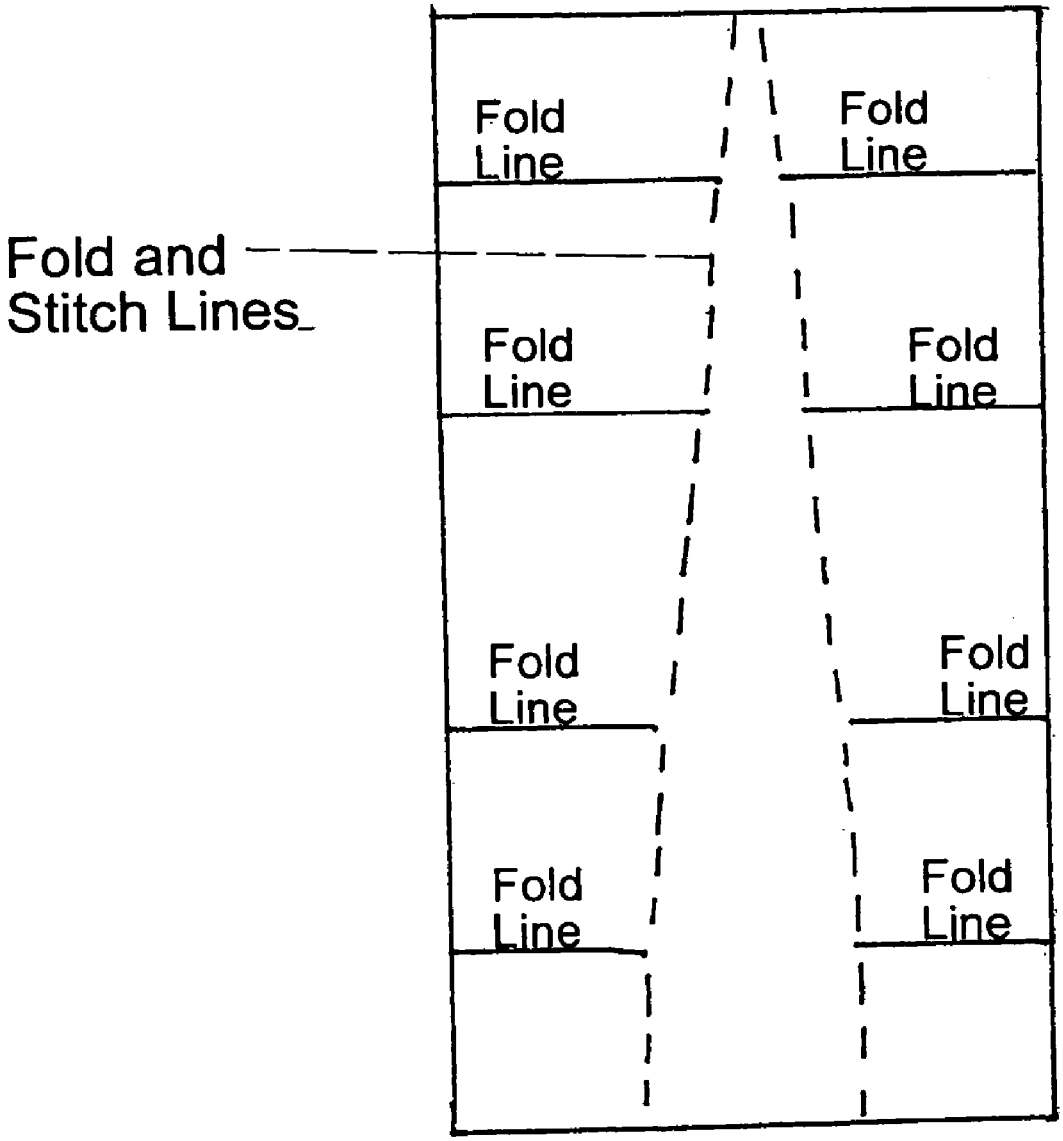
FIG. 14 is a plan view of a template used in the cutting and sewing of the protective cloth used in the construction of a horizontal 45 degree fire barrier so as to produce a cloth to fit around an expansion joint that comprises a horizontal 45 junction without having excess cloth bulk or causing tearing of the cloth.

FIG. 14 is a plan view of a template used in the folding and seaming of protective cloth used in the construction of a horizontal 45 degree fire barrier so as to produce a cloth to fit around an expansion joint that comprises a horizontal 45 junction without having excess cloth bulk or causing tearing of the cloth. Cutting is not required to achieve the horizontal 45 degree fire barrier. In this example, the protective cloth, once cut to conform to the template, as shown, is folded and seamed along the fold and stitch lines and then folded up along the inner set of the fold lines and folded out along the outer set of fold lines. At this point, the protective blanket is ready for the addition of a layer of insulation blanket and a layer of intumescent material.

Figure 15:
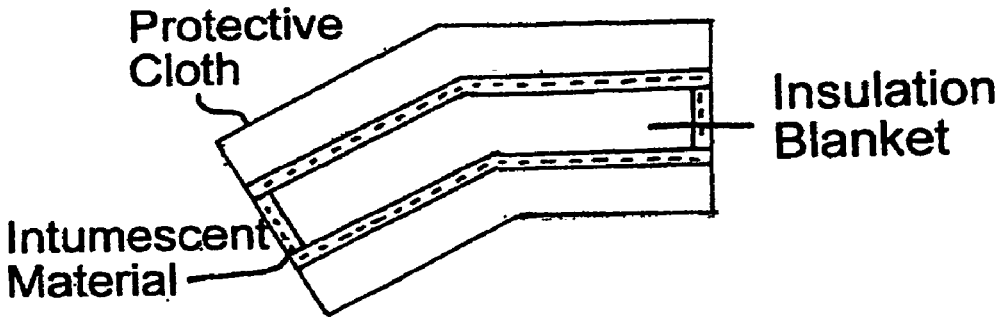
FIG. 15 is a plan view looking down onto a horizontal 45 degree fire barrier prepared for installation.

FIG. 15 is a plan view looking down onto a horizontal 45 degree fire barrier with attached layers of insulation blanket and intumescent material ready for installation in a the horizontal 45 degree expansion joint.

Figure 16:
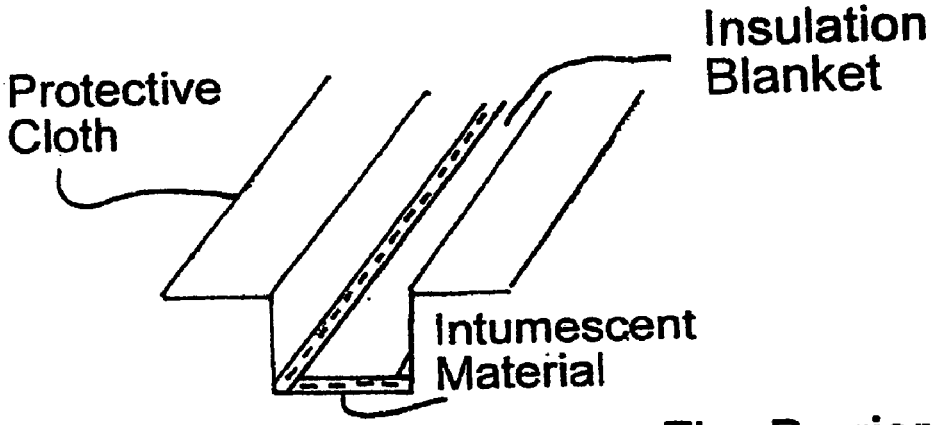
FIG. 16 is a perspective view of the horizontal 45 degree fire barrier, as shown in FIG. 15, ready to be installed.

FIG. 16 is a perspective view of one end of the horizontal 45 degree fire barrier, as shown in FIG. 15, ready to be installed.

Figure 17:
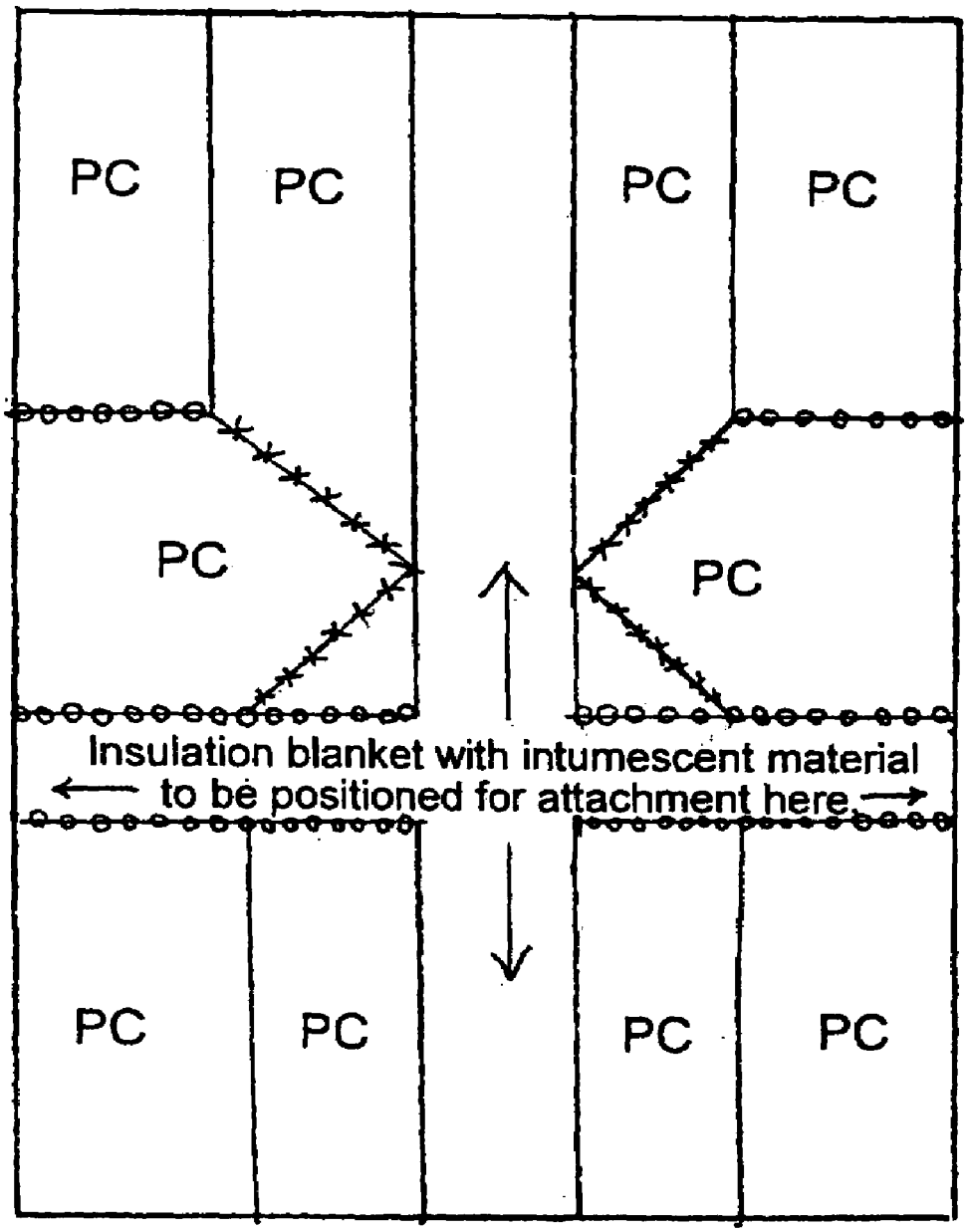
FIG. 17 is a plan view of a template used in the cutting and sewing of the protective cloth used in the construction of a horizontal T-joint/vertical fire barrier so as to produce a cloth to fit around a horizontal T-joint/vertical expansion joint without having excess cloth bulk or causing tearing of the cloth.
Figure 18:
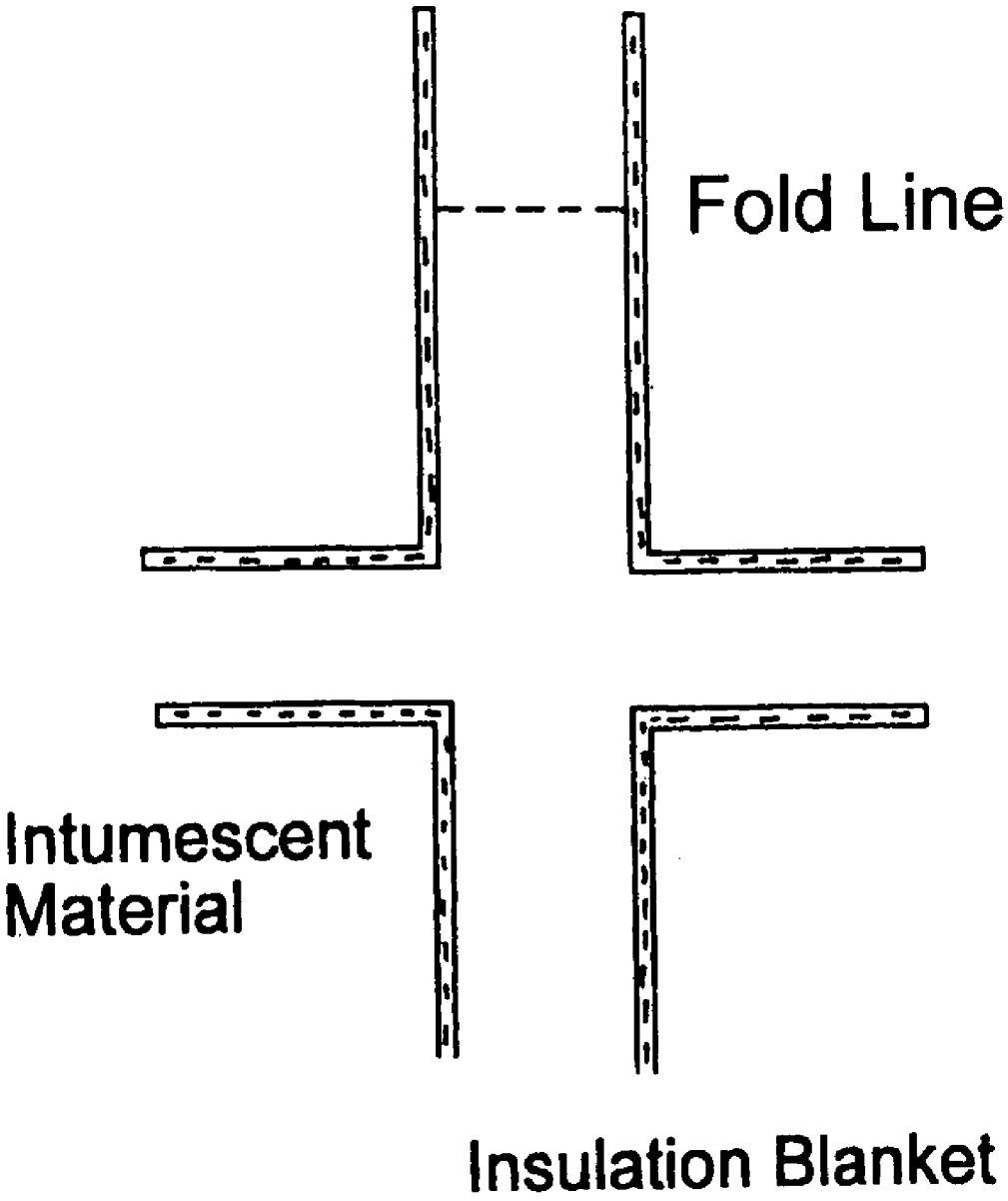
FIG. 18 is a plan view looking down onto an unfolded insulation blanket with intumescent material positioned on the insulation blanket ready for fitting into a protective cloth cut and sewn to fit into a horizontal T-joint/vertical expansion joint fire barrier.

FIG. 17 is a plan view of a template used in the cutting, folding, and sewing of the protective cloth used in the construction of a horizontal T-joint/vertical fire barrier so as to produce a cloth to fit around a horizontal T-joint/vertical expansion joint without having excess cloth bulk or causing tearing of the cloth. The lines that are to be used as cutting guides, are Illustrated in FIG. 17, as the lines marked with circles, whereas the lines that to be used as the pattern for folding and seaming are the lines marked with "X"s. The plain lines are guides for folding only. As seen in the figure, the T-shaped area on which a suitable shaped insulation blanket is to be placed is marked according. Once the cloth has been cut, folded, and seamed according to the template as illustrated in FIG. 17, FIG. 18 is a plan view looking down onto an unfolded, but T-shaped insulation blanket with an intumescent material layer positioned on the insulation blanket layer. These two layers are ready for fitting into a protective cloth cut and sewn following the horizontal T-joint/vertical fire barrier template as illustrated in FIG. 17.

Figure 18A:
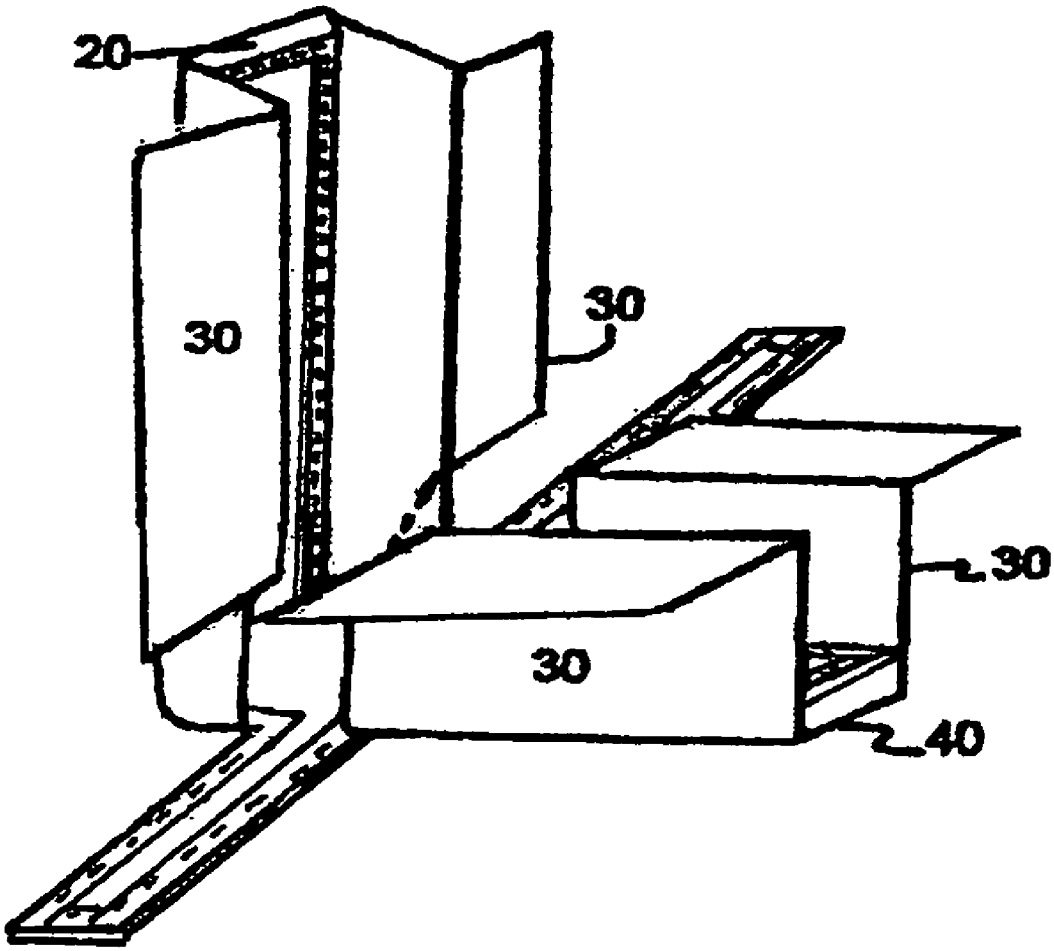
FIG. 18*a* is a perspective view of the cut, folded, and seamed fire barrier sized and shaped to fit a horizontal T-joint/vertical expansion joint with the insulation blanket and intumescent material, as shown in FIG. 18 positioned in the cut, folded, and seamed fire barrier.
Figure 18B:
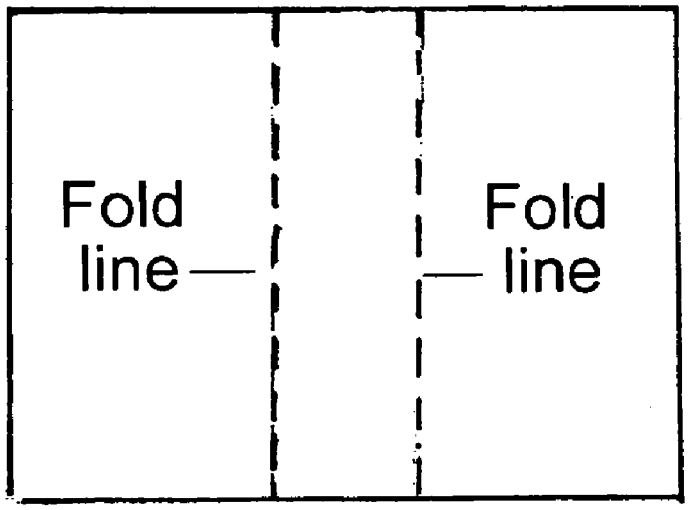
FIG. 18*b* is a plan view of the template that is used to cut the protective cloth that is to be positioned under and about the T-shaped extension arms as illustrated in FIG. 18*a*.

FIG. 18*a*, a perspective view of the cut, folded, and seamed fire barrier sized and shaped to fit a horizontal T-joint/vertical expansion joint with the insulation blanket and intumescent material, as shown in FIG. 18 positioned in the cut, folded, and seamed fire barrier, shows the partially assembled barrier ready for the protective cloth, cut according to the template illustrated in FIG. 18*b*, to be positioned under and about the T-shaped extensions.

FIG. 18*b* is a plan view of the template that is used to cut the two pieces of protective cloth, where each piece is to be positioned under and about the extended T-shaped extension arms, as illustrated in FIG. 18*a*. This addition provides a protective and supportive layer to hold the insulation blanket/intumescent material layers that are to be installed next.

Figure 19:
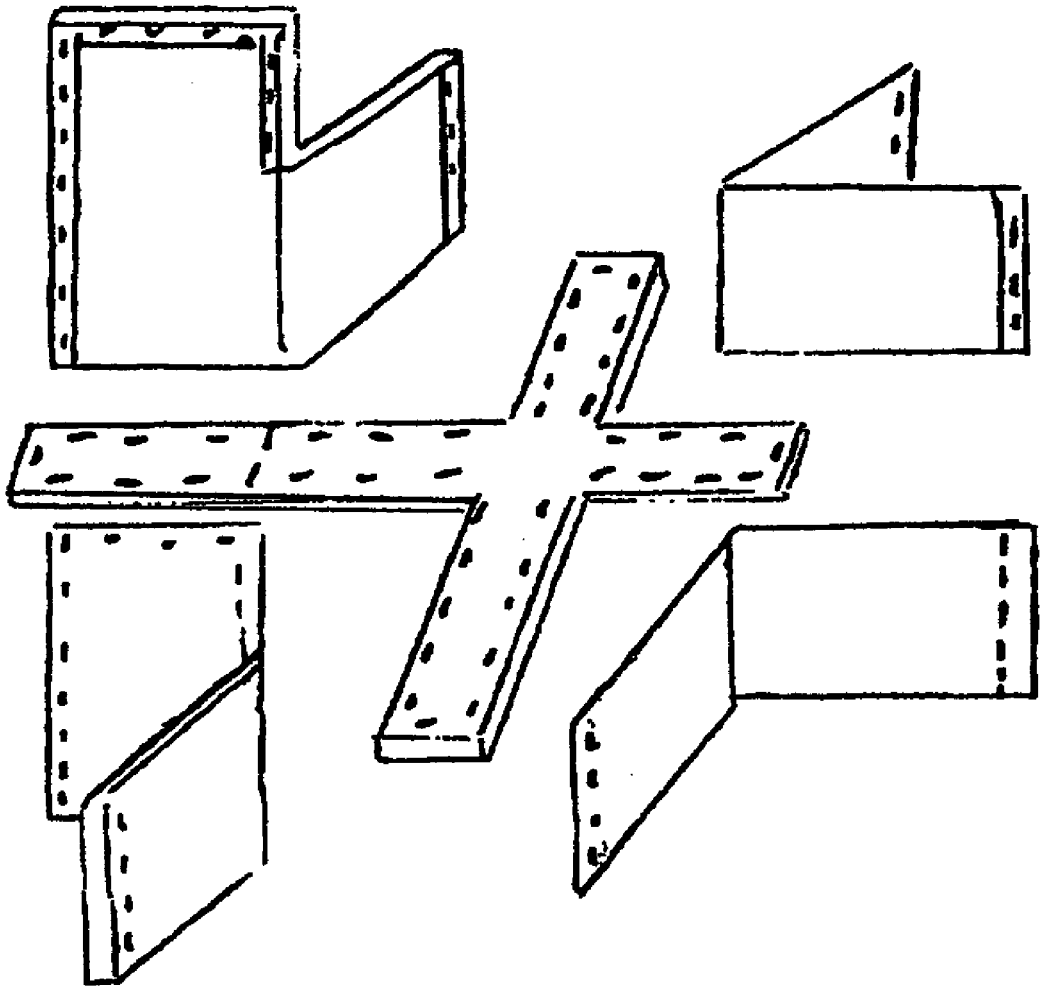
FIG. 19 is a perspective view of the four additional insulation blanket/intumescent material parts that will complete the side walls for that part of the horizontal T-joint/vertical expansion joint fire barrier. These pieces are to be inserted inside of the protective cloth coverings (i.e., shown as a template in FIG. 18*b*. The T-shaped structure (as is shown in FIG. 18.) is in the figure only as a guide for the placement of the insulation blanket/intumescent material parts. This step will complete the assembly of the horizontal T-joint/vertical expansion joint fire.

FIG. 19 is a perspective view of the four additional insulation blanket/intumescent material parts that will complete the layered side walls for the T-shaped extension arm part of the horizontal T-joint/vertical expansion joint fire barrier. The insulation blanket/intumescent material parts, as shown in FIG. 19, are to be inserted inside of the protective cloth coverings (i.e., shown as a template in FIG. 18*b*). The T-shaped structure (as is shown in FIG. 18.) is shown again in this figure only as a guide for the placement of the insulation blanket/intumescent material parts. This step will complete the assembly of the horizontal T-joint/vertical expansion joint fire.

Figure 19A:
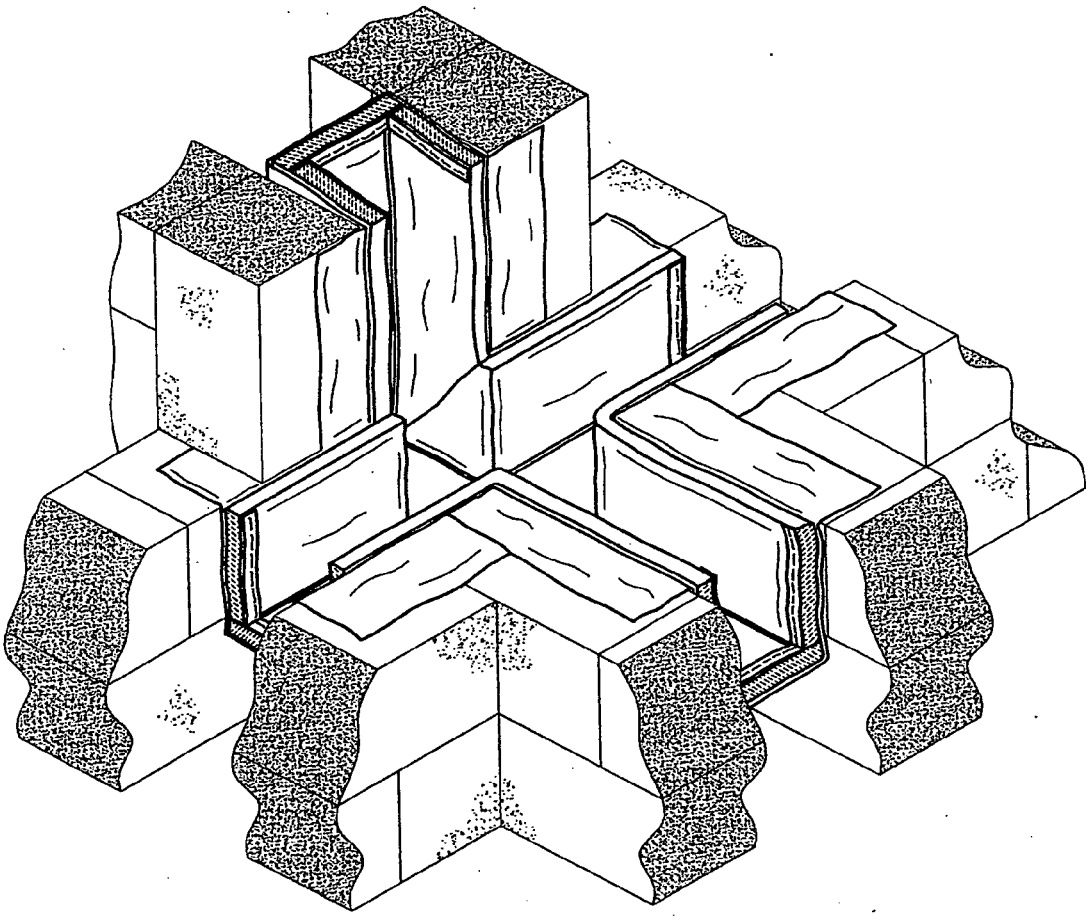
FIG. 19*a* is a perspective view of a horizontal T-joint/vertical expansion joint fire barrier installed in a model horizontal T-joint/vertical expansion joint structure. In this illustration the intumescent strip layer is about to be positioned on the insulation blanket. The barrier is shown temporarily attached to the model structure with clamps.
Figure 19B:
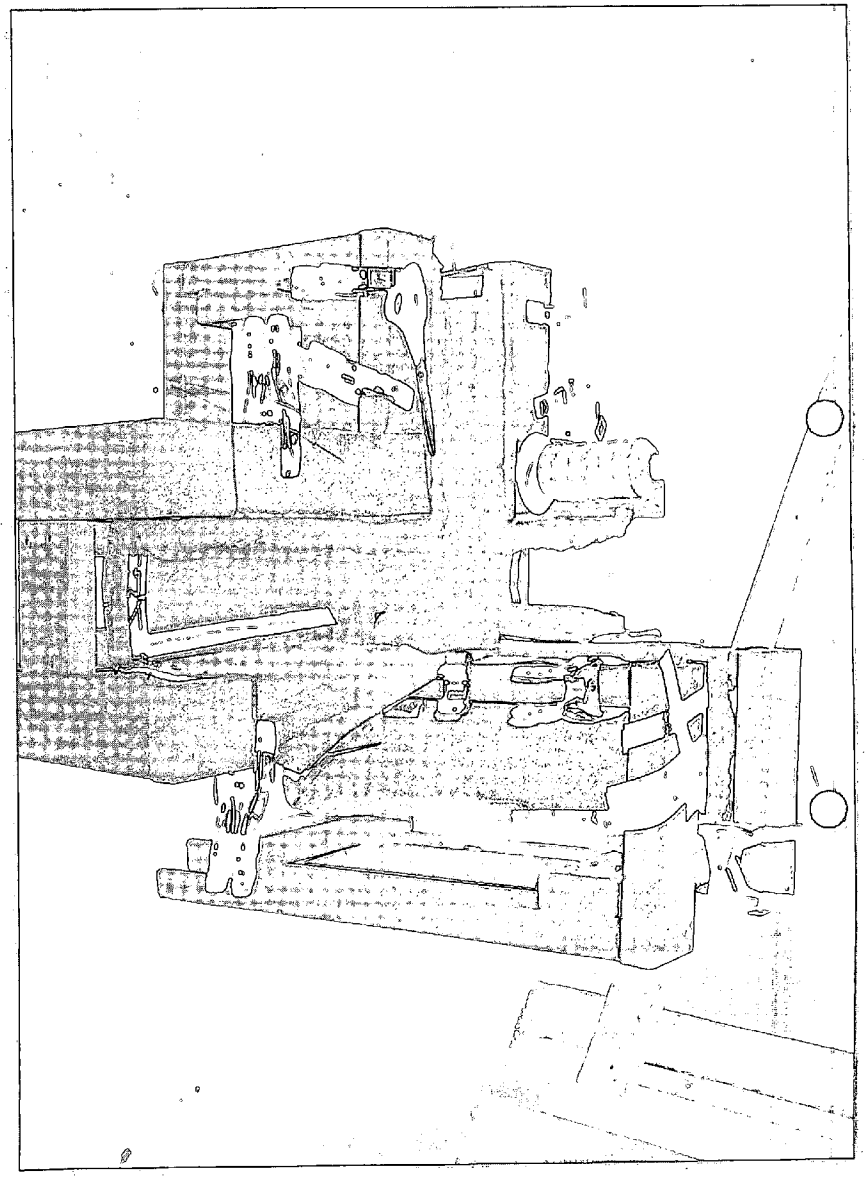
FIG. 19*b* is another perspective view of a horizontal T-joint/vertical expansion joint fire barrier installed in a model horizontal T-join/vertical expansion joint structure.

FIG. 19*a* is a perspective view of a horizontal T-joint/vertical expansion joint fire barrier installed in a model horizontal T-joint/vertical expansion joint structure for seaming and for purposes of illustration. In this illustration the intumescent strip layer is about to be positioned on the insulation blanket side walls. The barrier is shown temporarily attached to the model structure with clamps. FIG. 19*b* is another view of the horizontal T-joint/vertical expansion joint fire barrier as shown in FIG. 19*a*.

FIG. 20 is a plan view illustrating four schematic multi-dimensional expansion joint structures. Of course, it is appreciated that there are many variation of multi-dimensional expansion joint structures.

Figure 21:
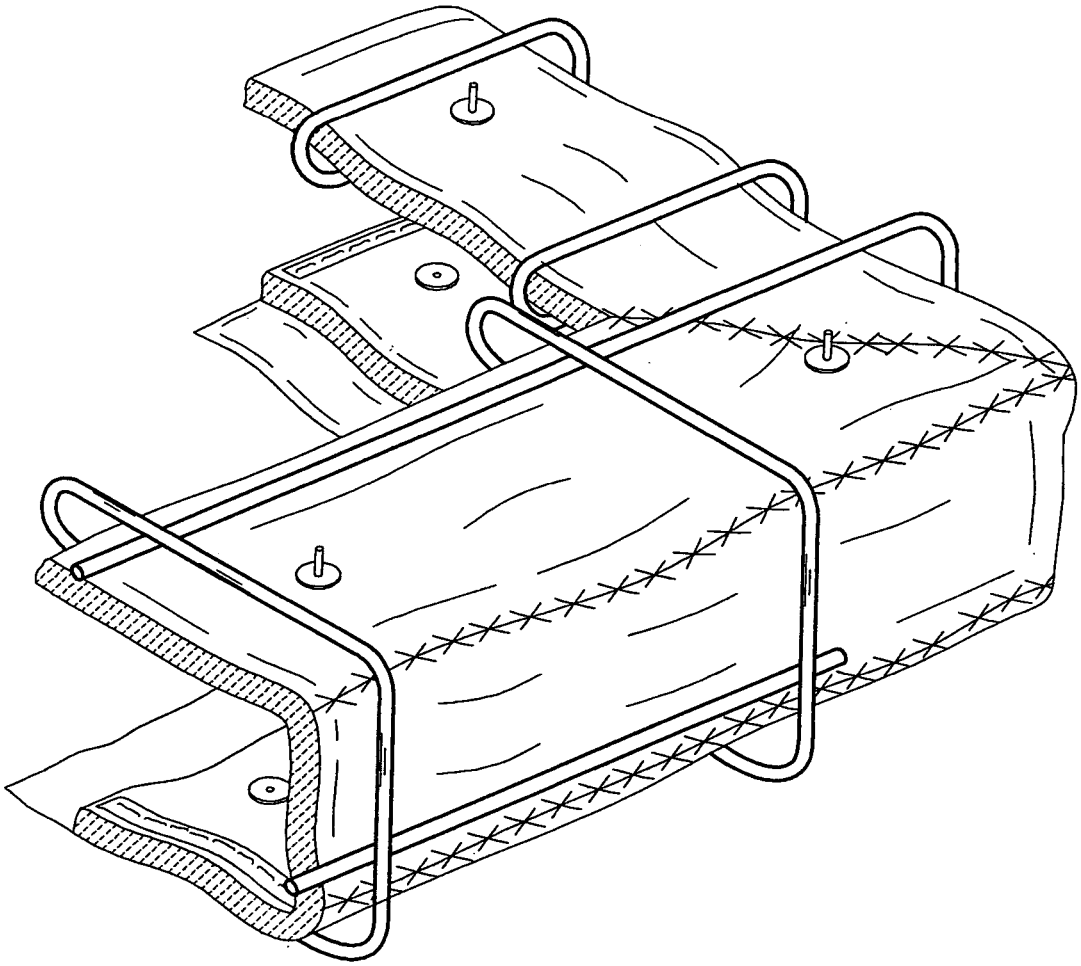
FIG. 21 is a perspective view of the novel work form that is required for the seaming of a fire barrier that is shaped and sized to fit into a 90 degree expansion joint structure.

FIG. 21 is a perspective view of the novel work form that has been designed to hold the barrier that is shaped and sized to fit into a 90 degree expansion joint structure for seaming.

Figure 21A:
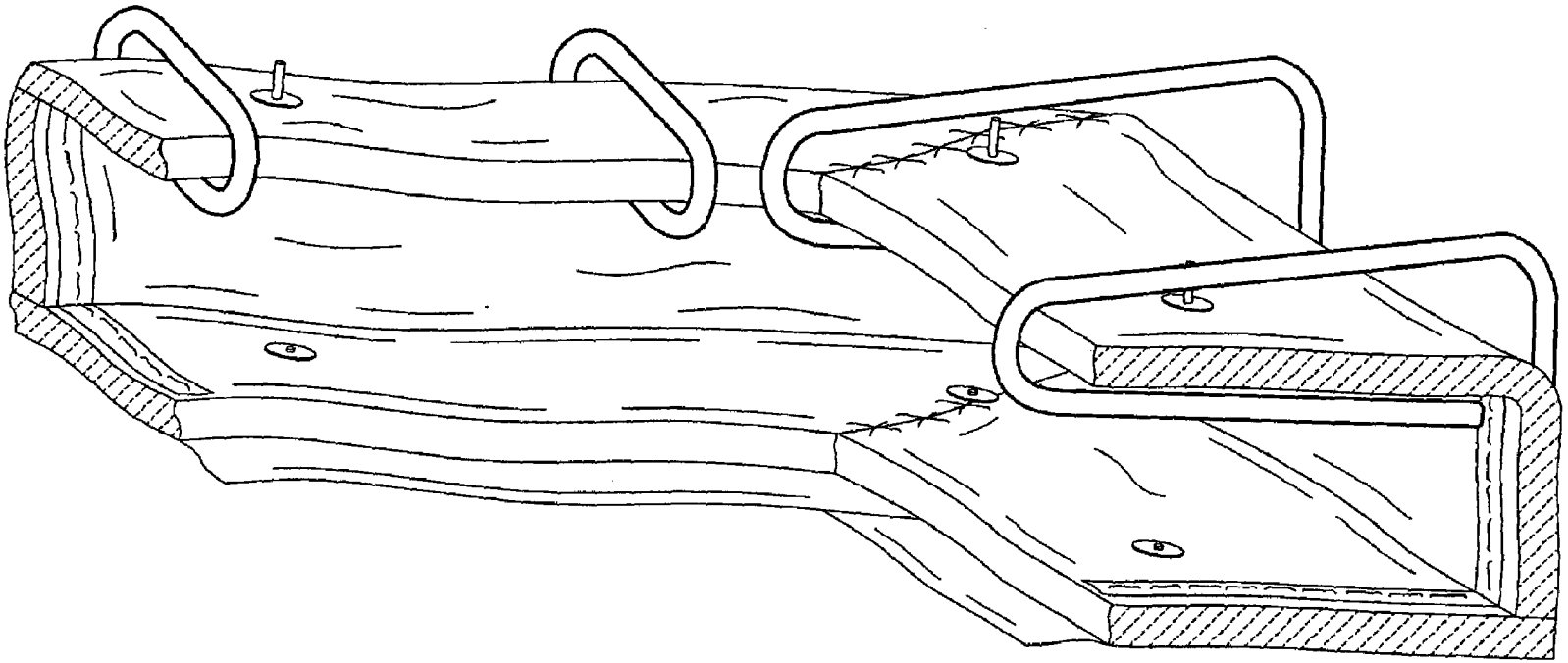
FIG. 21*a* is another perspective view of the novel work form that is required for the seaming of a fire barrier that is shaped and sized to fit into a 90 degree expansion joint structure.

FIG. 21*a* is another perspective view of the novel work form that is required for the seaming of a fire barrier that is shaped and sized to fit into a 90 degree expansion joint structure.

Thus, it can be seen from the above that the present invention provides the solution to the long felt and extremely important safety need for means to prevent the rapid spread of flames, heat, and smoke throughout multi-dimensional expansion joints of any type of structure by providing fire barriers styled and sized to fit multi-dimensional expansion joints, as well as the method of making the barriers, and the forms on which the barriers are seamed. Moreover, as the multi-dimensional fire barriers of the present invention may be constructed of presented available and permitted materials, the added cost to manufacture the barrier is minimal, thus making these essential safety features, affordable.

The foregoing description, for purposes of explanation, used specific and defined nomenclature to provide a thorough understanding of the invention. However, it will be apparent to one skilled in the art that the specific details are not required in order to practice the invention. The disclosed descriptions and illustrations are not intended to be exhaustive or to limit the invention to the precise forms disclosed. Those skilled in the art will recognize that many changes may be made to the features, embodiments, and methods of making the versions of the invention described herein without departing from the spirit and scope of the invention, such as adjusting the template patterns shown in the drawings and described above to fit the variety of other similar, but different, multi-dimensional expansion joints, as well as to fit the various sizes of multi-dimensional joints that require fire barriers. Furthermore, the present invention is not limited to the described methods, embodiments, features or combinations of features but include all the variation, methods, modifications, and combinations of features within the scope of the appended claims. The invention is limited only by the claims.

What is claimed is:

1. Multi-dimensional fire barriers shaped for use in multi-dimensional architectural expansion joints comprising a plurality of fire resistant material layers, comprising:

a) at least one intumescent layer;

b) at least one insulating layer having a length, a width, a first lateral surface, and a second lateral surface;

c) at least one mechanical support layer having a length, a width, a first lateral surface, and a second lateral surface, d) said width of said mechanical support layer being greater than said width of said insulating layer;

e) said intumescent layer positioned against said first lateral surface of said insulating layer; and f) said mechanical support layer positioned against said second lateral surface of said insulating layer so that the width of said mechanical support layer is parallel to but extends beyond the width of said insulating layer, g) said mechanical support layer, said insulating layer, and said intumescent layer affixed together providing for a multi-dimensional fire barrier configured for fitting an L-shaped expansion joint that occurs at junctions formed by the confluence of at least one wall and a floor or by the confluence of at least one wall and a ceiling, wherein said fire barrier configuration described as:

a planar member with a first surface having a length and a width, said planar member folded across said length bringing a first part of said first surface of said planar member toward a second part of said first surface of said planar member providing for said first part of said first surface to be positioned at about 90 degrees from said second part of said first surface, each diametrically opposed edge of said first part having an extending side member; said side member folded to an angle 90 degrees from said first surface of said first part, said side members each having a flange part extending away from said side member and away from said first surface of said first part, each diametrically opposed edge of said second part having an extending side member; said side member folded to an angle 90 degrees from said first surface of said second part, said side members each having a flange part extending away from said side member and away from said first surface of said second part, each of said flanges providing means for attaching said shaped fire barrier to a building unit.

2. The multi-dimensional fire barriers as recited in claim 1, further comprising wherein said mechanical support layer comprises one selected from the group consisting of continuous filament amorphous silica yarns, polymeric material, fiber reinforced polymeric material, metallized fiber reinforced polymeric material, metallized, fiberglass cloth material, and inorganic fiber cloth material.

3. The multi-dimensional fire barriers, as recited in claim 1, further comprising wherein said insulating layer is made from a refractory fiber.

4. The multi-dimensional fire barriers, as recited in claim 1, further comprising wherein said intumescent layer contains intumescent material selected from the group consisting of unexpanded vermiculite, hydrobiotite, water-swelling tetrasilicic fluorine mica, expandable graphite, and mixtures thereof.

5. The multi-dimensional fire barriers, as recited in claim 1, further comprising wherein said mechanical support layer, said insulating layer, and said intumescent layer are locally affixed together substantially continuously along the length of said layers by stitching.

6. The multi-dimensional fire barriers, as recited in claim 5, further comprising wherein said stitching connection means comprises high temperature thread.

7. The multi-dimensional fire barriers, as recited in claim 1, further comprising wherein said mechanical support layer, said insulating layer, and said intumescent layer are locally affixed together substantially continuously along the length of said layers by stapling.

8. The multi-dimensional fire barriers, as recited in claim 1, further comprising wherein said mechanical support layer, said insulating layer, and said intumescent layer are locally affixed together substantially continuously along the length of said layers by pins and bolts.

9. The multi-dimensional fire barriers as recited in claim 1, further comprising wherein said at least one intumescent layer is shaped for positioning about the edges of said insulation blanket layer.

* * * * *